US012158053B2

(12) United States Patent
Sherief et al.

(10) Patent No.: US 12,158,053 B2
(45) Date of Patent: Dec. 3, 2024

(54) SELECTIVE ZONAL ISOLATION

(71) Applicant: Saudi Arabian Oil Company, Dhahran (SA)

(72) Inventors: Mohamed H. Sherief, Dhahran (SA); Ayman M. Almohsin, Dhahran (SA); Haider J. Abulal, Dhahran (SA); Mohammed I. Alabdrabalnabi, Al Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 314 days.

(21) Appl. No.: 17/550,138

(22) Filed: Dec. 14, 2021

(65) Prior Publication Data

US 2023/0184051 A1 Jun. 15, 2023

(51) Int. Cl.

| | |
|---|---|
| ***E21B 33/138*** | (2006.01) |
| ***E21B 33/124*** | (2006.01) |
| ***E21B 43/32*** | (2006.01) |
| ***E21B 47/07*** | (2012.01) |
| *E21B 43/14* | (2006.01) |

(52) U.S. Cl.
CPC ..... *E21B 33/138* (2013.01); *E21B 33/124* (2013.01); *E21B 47/07* (2020.05); *E21B 43/14* (2013.01); *E21B 43/32* (2013.01)

(58) Field of Classification Search
CPC ..... E21B 33/138; E21B 47/07; E21B 33/124
See application file for complete search history.

(56) References Cited

U.S. PATENT DOCUMENTS

| | | | | |
|---|---|---|---|---|
| 796,909 | A | 8/1905 | Hardison | |
| 2,229,177 | A | 1/1941 | Kennedy et al. | |
| 2,630,410 | A | 3/1953 | Clapsadle et al. | |
| 3,629,102 | A | 12/1971 | Lummus et al. | |
| 3,708,428 | A | 1/1973 | McDonald | |
| 3,713,489 | A | 1/1973 | Fast et al. | |
| 3,747,677 | A | 7/1973 | Richardson | |
| 4,064,941 | A * | 12/1977 | Smith | E21B 43/25 166/305.1 |

(Continued)

FOREIGN PATENT DOCUMENTS

| | | |
|---|---|---|
| AU | 2018269421 | 12/2019 |
| CA | 2870904 | 11/2013 |

(Continued)

OTHER PUBLICATIONS

Aimohsin et al., "Nanosilica Based Fluid System for Water Shut-Off," Jul. 2017.

(Continued)

*Primary Examiner* — Blake Michener
*Assistant Examiner* — Neel Girish Patel
(74) *Attorney, Agent, or Firm* — Fish & Richardson P.C.

(57) ABSTRACT

A method of treating a region of a subterranean formation adjacent a wellbore zone, the method including cooling the wellbore zone to a wellbore temperature below a temperature of the region of the subterranean formation adjacent the wellbore zone, injecting a gellable treatment composition through the wellbore zone into the region of the subterranean formation adjacent the wellbore zone, and allowing the gellable treatment composition to gel in the region to prevent or reduce flow of an unwanted fluid from the region into the wellbore zone.

25 Claims, 15 Drawing Sheets

(56) References Cited

U.S. PATENT DOCUMENTS 4,091,868 A * 5/1978 Kozlowski ..... E21B 33/138 166/295
4,485,875 A * 12/1984 Falk ..... E02D 3/12 166/295
4,624,870 A 11/1986 Anthony
4,665,984 A 5/1987 Hayashi et al.
4,732,213 A 3/1988 Bennett et al.
4,809,781 A 3/1989 Hoefner
4,899,818 A * 2/1990 Jennings, Jr. ..... E21B 33/138 166/295
4,901,797 A 2/1990 Summers et al.
4,927,749 A 5/1990 Dorn
4,947,933 A * 8/1990 Jones ..... C09K 8/512 166/272.3
4,974,677 A * 12/1990 Shu ..... E21B 43/24 166/272.3
5,125,456 A 6/1992 Hutchins et al.
5,168,928 A 12/1992 Terry et al.
5,178,217 A 1/1993 Mohammadi et al.
5,185,024 A 2/1993 Siemer et al.
5,320,171 A 6/1994 Laramay
5,351,757 A 10/1994 Chou et al.
5,368,833 A 11/1994 Johansson et al.
5,617,920 A 4/1997 Dovan et al.
5,697,441 A 12/1997 Vercaemer
5,836,390 A 11/1998 Apps et al.
5,957,203 A 9/1999 Hutchins et al.
6,516,885 B1 2/2003 Munday
7,013,973 B2 3/2006 Danican et al.
7,273,101 B2 9/2007 Davies et al.
7,458,424 B2 12/2008 Odeh et al.
7,562,710 B2 7/2009 Buchanan
7,642,223 B2 * 1/2010 Santra ..... E21B 33/138 507/221
7,677,313 B2 3/2010 Tremblay et al.
7,712,528 B2 5/2010 Langdon
7,854,277 B2 12/2010 Duncum et al.
7,934,557 B2 5/2011 Nguyen
7,954,549 B2 6/2011 Lende et al.
7,985,789 B2 7/2011 Albalat Perez et al.
8,053,479 B2 11/2011 Masuda et al.
8,132,623 B2 3/2012 Allin et al.
8,557,916 B1 10/2013 Alsharaeh et al.
8,672,023 B2 3/2014 O'Malley et al.
8,822,386 B2 9/2014 Quintero et al.
8,853,301 B2 10/2014 Jing et al.
9,045,965 B2 6/2015 Patil et al.
9,133,386 B2 9/2015 Kumar et al.
9,315,721 B2 4/2016 Mahoney et al.
9,464,504 B2 10/2016 Kakdjian et al.
9,475,981 B2 10/2016 Abivin et al.
9,932,521 B2 4/2018 Soane et al.
9,951,593 B2 4/2018 Hussein et al.
10,683,726 B1 6/2020 Al-Mulhenn et al.
10,774,211 B2 9/2020 Alnnohsin
10,920,063 B2 2/2021 Almohsin et al.
11,015,050 B2 5/2021 Alnnohsin
11,053,426 B2 7/2021 Kalgaonkar et al.
11,104,838 B2 8/2021 Bataweel et al.
11,111,754 B2 9/2021 Al-Mulhem et al.
11,220,581 B2 1/2022 Almohsin et al.
2003/0121662 A1 7/2003 Bosma
2004/0154799 A1 8/2004 Powell
2004/0157749 A1 8/2004 Ely et al.
2005/0194190 A1 * 9/2005 Becker ..... E21B 33/138 175/320
2007/0029085 A1 2/2007 Panga et al.
2008/0035343 A1 2/2008 Odeh et al.
2008/0289812 A1 11/2008 El-Khazindar et al.
2009/0010364 A1 4/2009 Schafer et al.
2009/0143490 A1 6/2009 Masuda et al.
2009/0205818 A1 8/2009 Klunge et al.
2009/0221453 A1 9/2009 Mukhopadhyay et al.
2010/0055458 A1 3/2010 Jang et al.
2010/0096139 A1 4/2010 Holcomb
2010/0119850 A1 5/2010 Browne et al.
2010/0224366 A1 9/2010 Lende et al.
2010/0230169 A1 9/2010 Pomerleau
2010/0252259 A1 10/2010 Horton
2011/0088899 A1 * 4/2011 Stehle ..... E21B 33/138 166/270
2011/0094746 A1 4/2011 Allison et al.
2011/0214867 A1 9/2011 Reddy
2012/0059089 A1 3/2012 Greenwood et al.
2012/0103607 A1 5/2012 Fitzpatrick
2012/0255887 A1 10/2012 Holms et al.
2012/0267098 A1 * 10/2012 Peirce ..... C09K 8/524 166/277
2013/0065798 A1 3/2013 Amanullah et al.
2013/0149211 A1 6/2013 Bielawski et al.
2013/0166156 A1 6/2013 Lin
2013/0248187 A1 * 9/2013 Al-Anazi ..... E21B 23/08 166/212
2013/0292120 A1 11/2013 Patil et al.
2013/0317135 A1 11/2013 Vega
2014/0102704 A1 * 4/2014 Patil ..... E21B 33/13 166/293
2014/0144637 A1 5/2014 Gerrard
2014/0158354 A1 6/2014 Kumar et al.
2014/0174739 A1 * 6/2014 Bourcier ..... E21B 33/13 166/292
2014/0262283 A1 * 9/2014 Savari ..... E21B 36/001 166/305.1
2014/0290943 A1 10/2014 Ladva et al.
2015/0027710 A1 1/2015 Miller
2015/0047846 A1 2/2015 van Oort et al.
2015/0060064 A1 3/2015 Lafferty et al.
2015/0159079 A1 6/2015 Huh et al.
2015/0322328 A1 11/2015 Boul et al.
2015/0344765 A1 12/2015 Kumar et al.
2016/0230072 A1 * 8/2016 Reddy ..... E21B 43/04
2016/0304772 A1 10/2016 Al-Harbi
2016/0344035 A1 11/2016 Zhamu et al.
2017/0058186 A1 3/2017 Oghena
2018/0163122 A1 6/2018 Panga et al.
2018/0193261 A1 7/2018 Lee et al.
2018/0327648 A1 * 11/2018 Bataweel ..... C04B 28/24
2018/0362827 A1 * 12/2018 Bataweel ..... C09K 8/46
2019/0071596 A1 * 3/2019 Alshehri ..... C09K 8/512
2019/0112468 A1 4/2019 Almohsin et al.
2019/0162051 A1 * 5/2019 Hoffman ..... E21B 27/02
2019/0214647 A1 7/2019 Arsalan
2019/0256770 A1 8/2019 He et al.
2020/0048527 A1 2/2020 Bataweel et al.
2020/0408063 A1 12/2020 Almohsin et al.
2021/0040814 A1 * 2/2021 Roback ..... E21B 33/138
2021/0130555 A1 5/2021 Almohsin et al.
2021/0363402 A1 11/2021 Bataweel et al.

FOREIGN PATENT DOCUMENTS

CA 2891220 6/2014
CA 3063594 11/2018
CN 1221445 6/1999
CN 1745157 3/2006
CN 104449631 3/2015
CN 105755185 7/2016
CN 105801783 7/2016
CN 105924599 9/2016
CN 107814869 3/2018
EP 1866518 12/2007
EP 2454446 A1 5/2012
EP 171753445 6/2017
EP 3331964 6/2018
EP 2454446 B1 9/2019
EP 3619279 3/2020
EP 3619280 3/2020
GB 2106956 4/1983
GB 2503627 1/2014
GB 2506603 4/2014
JP 2005526887 9/2005
RU 2152967 7/2000

(56) References Cited

FOREIGN PATENT DOCUMENTS

| | | |
|---|---|---|
| RU | 2001132070 | 3/2004 |
| RU | 2008116114 | 10/2009 |
| RU | 2010130026 | 1/2012 |
| WO | WO 1995000739 | 1/1995 |
| WO | WO 1998037014 | 8/1998 |
| WO | WO 1999036359 | 7/1999 |
| WO | WO 2003033618 | 4/2003 |
| WO | WO 2004018381 | 3/2004 |
| WO | WO 2004035473 | 4/2004 |
| WO | WO 2004035474 | 4/2004 |
| WO | WO 2007017806 | 2/2007 |
| WO | WO 2008118239 | 10/2008 |
| WO | WO 2009034287 | 3/2009 |
| WO | WO 2010070600 | 6/2010 |
| WO | WO 2013107789 | 7/2013 |
| WO | WO 2014085770 | 6/2014 |
| WO | WO 2015124214 | 8/2015 |
| WO | WO 2019075314 | 4/2019 |

OTHER PUBLICATIONS

Al-Ghazal et al., "A new temporary chemical packer enables efficient stimulation of a lower zone in a HPHT gas well," SPE 161651, Society of Petroleum Engineers (SPE), presented at the Abu Dhabi International Petroleum Exhibition and Conference on Nov. 11-14, 2012, 6 pages.

Al-Muntasheri et al., "Investigation of a High Temperature Organic Water Shutoff Gel: Reaction Mechanisms," Society of Petroleum Engineers (SPE), Dec. 2006, 8 pages.

Alsharaeh et al., "Evaluation of nanomechanical properties of (styrene-methyl methacrylate) copolymer composites containing graphene sheets," American Chemical Society, 2013, 11 pages.

Alsharaeh et al., "Microwave irradiation effect on the dispersion and thermal stability of RGO nanosheets within a polystyrene matrix," Materials, 2014, 7:212-224.

Bai et al., "Case Study on Preformed Particle Gel for in-depth Fluid Diversion," SPE 113997, Society of Petroleum Engineers (SPE), proceedings from the SPE/DOE Improved Oil Recovery Symposium, Apr. 19-23, 2008, 18 pages.

Chen et al., "Polyacrylamide and its derivatives for oil recovery," Dissertation for the degree of Doctor of Philosophy, Missouri University of Science and Technology, Fall 2016, 226 pages.

Dalrymple, "[5]P14 Water Control Treatment Design Technology," SPE 29194, Society of Petroleum Engineers (SPE), proceedings of the 15th World Petroleum Congress, Oct. 12-17, 1997, 3 pages.

Dovan et al., "Delaying Gelation of Aqueous Polymers at Elevated Temperatures Using Novel Organic Crosslinkers," SPE 37246, Society of Petroleum Engineers (SPE), presented at the SPE International Symposium Oilfield Chemistry, Houston, TX, Feb. 18-21, 1997, 11 pages.

Esmaeilzadeh et al., "Wettability alteration of carbonate rocks from liquid-wetting to ultra gas-wetting using TiO2, SiO2 and CNT nanofluids containing flurorchemicals, for enhanced gas recovery," Journal of Natural Gas Science and Engineering, vol. 26, Sep. 2015, 12 pages.

Freyer et al., "Swelling Packer for Zonal Isolation in Open Hole Screen Completions," SPE 78312, Society of Petroleum Engineers (SPE), presented at the SPE 13th European Petroleum Conference, Oct. 29-31, 2002, 5 pages.

Gilardo et al., "Wettability alteration of sandstone cores by alumina-based nanofluids," Energy and Fuels, 27:7, Jul. 18, 2013, 7 pages.

Greenwood and Gevert, "Aqueous silane modified silica sols: theory and preparation," Pigment and Resin Technology, 40:5, 2011, 10 pages.

Gunnarsson et al., "Technology Update: New Tool and Sealant Technology Expedites Annular Isolation Tasks," Society of Petroleum Engineers (SPE), JPT, Jul. 2016, 2 pages.

Huang et al., "Systematic Approach to Develop a Colloidal Silica Based Gel System for Water Shut-Off," SPE-183942-MS, Society of Petroleum Engineers (SPE), Mar. 9, 2017, 19 pages.

Iler and Dalton, "Degree of Hydration of Particles of Colloidal Silica in Aqueous Solution," Journal of Physical Chemistry, 60:7, Jul. 1956, 3 pages.

Iller, "The Chemistry of Silica," John Wiley & Sons, Jun. 1979, 5 pages.

Khan et al., "Graphene based metal and metal oxide nanocomposites: synthesis, properties and their applications," Journal of Materials Chemistry A, 3:37, Jan. 1, 2015, 57 pages.

Kondiparty et al., "Dynamic Spreading of Nanofluids on Solids. Part 1: Experimental," American Chemical Society, Langmuir 28, Sep. 11, 2012, 6 pages.

Kumar et al., "Nanostructured zirconia decorated reduced graphene oxide based efficient biosensing platform for non-invasive oral cancer detection," Biosensors and Bioelectronics, 78, Apr. 1, 2016, 8 pages.

Li et al., "Fabrication and properties of machinable 3Y-Zr02/BN nanocomposites," Materials Science and Engineering: A, Elsevier, Amsterdam, 397:1-2, Apr. 25, 2005, 6 pages.

Ligthelm, "Water Shut-off in Gas Wells: Is there Scope for a Chemical Treatment?," SPE 68978, Society of Petroleum Engineers (SPE), presented at the SPE European Formation Damage Conference, May 21-22, 2001, 10 pages.

Liu et al., "Microwave-assisted synthesis of TiO2-reduced graphene oxide composites for the photocatalytic reduction of Cr(vi)," RSC Advances, 1:7, Jan. 1, 2011, 5 pages.

Liu et al., "Photolatently modulable hydrogels using unilamellar titania nanosheets as photocatalytic crosslinkers," Nature Communications, 4:1, Jun. 18, 2013, 7 pages.

Liu et al., "Tough and highly stretchable graphene oxide/polyacrylamide nanocomosite hydrogels," Journal of Materials Chemistry, 22:28, Jan. 1, 2012, 8 pages.

Mahdavi et al., "Polyacrylamide/reduced graphene oxide-Ag nanocomposite as highly efficient antibacterial transparent film," Iranian Chemical Society, Journal, 14:1, Aug. 6, 2016, 10 pages.

Michael et al., "Enhanced Polyacrylamide Polymer Gels using Zirconium Hydroxide Nanoparticles from Water Shutoff at High Temperatures: The Thermal and Rheological Investigations," Ind. Eng. Chem. Res., 57:48, Nov. 6, 2018, 27 pages.

Mordina et al., "Impact of graphene oxide on the magnetorheological behaviour of BaFe 12019 nanoparticles filled polyacrylamide hydrogel," Polymer, Elsevier Science Publishers B.V., GB, 97, May 11, 2016, 15 pages.

Nasr-El-Din and Taylor, "Evaluation of sodium silicate/urea gels used for water shut-off treatments," Journal of Petroleum Science and Engineering 48:3-4, Sep. 15, 2005, 20 pages.

Ogolo et al., "Enhanced Oil Recovery Using Nanoparticles," SPE 160847, Society of Petroleum Engineers (SPE), SPE International, presented at the SPE Saudi Arabia Section Technical Symposium and Exhibition, Apr. 8-11, 2012, 9 pages.

Pan et al., "Tough, Stretchable, Compressive, Novel Polymer/Graphene Oxide Nanocomposite Hydrogels with Excellent Self-Healing Performance," ACS Applied Materials and Interfaces, published online Oct. 11, 2017, 28 pages.

Pham et al., "Rheological evaluation of a sodium silicate gel system for water management in mature, naturally-fractured oilfields," Journal of Petroleum Science and Engineering, 138, Dec. 4, 2015, 16 pages.

Sears, "Determination of Specific Surface Area of Colloidal Silica by Titration with Sodium Hydroxide," Analytical Chemistry 28:12, Dec. 1956, 3 pages.

Sepehrinia and Mohammadi, "Wettability alteration properties of fluorinated silica nanoparticles in liquid-loaded pores: An atomistic simulation," Applied Surface Science 371, May 15, 2016, 11 pages.

Seright, "Washout of Cr (III)-Acetate-HPAM Gels from Fractures," SPE 80200, Society of Petroleum Engineers (SPE), proceedings from the SPE International Symposium on Oilfield Chemistry, Feb. 5-7, 2003, 10 pages.

Shan et al., "Graphene oxide enhanced polyacrylamide-alginate aerogels catalysts," Carbohydrate Polymers, 203, Jan. 1, 2019, 26 pages.

(56) References Cited

OTHER PUBLICATIONS

Song et al., "Plasma-induced grafting polyacrylamide on graphene oxide nanosheets for simultaneous removal of radionuclides," Physical Chemistry Chemical Physics (RSC Publishing), Jan. 1, 2015, 24 pages.
Stengl et al., "h-BN-TiO 2 Nanocomposite for Photocatalytic Applications," Journal of Nanomaterials, 2016, Jan. 1, 2016, 12 pages.
Taha et al., "Nano Graphene Application Improving Drilling Fluids Performance," presented at the International Petroleum Technology Conference, Doha, Qatar, Dec. 6-9, 2015, 16 pages.
Taha et al., "Overview of Water Shutoff Operations in Oil and Gas Wells; Chemical and Mechanical Solutions," chemengineering MDPI, Department of Petroleum Engineering, Texas A&M University at Qatar, May 2019, 3(2), 51, 11 pages.
Target Intervention No., "Real-Time, Fully Electric TP1 Straddle Tool," targetinvention.no, available on or before Feb. 13, 2018, 1 page.
Tongwa et al., "Evaluation of a nanocomposite hydrogel for water shut-off in enhanced oil recovery applications: Design, synthesis, and characterization," J. Appl. Polym. Sci, 2012, 128:787-794.
Veil et al., "A White Paper Describing Produced Water from Production of Crude Oil, natural Gas and Coal Bed methane," Technical Report prepared for the National Energy Technology Laboratory (US Doe, under Contract No. W-31-109-Eng-38, Jan. 2004, 87 pages.
Villamizar et al., "SPE 129901: Interfacially Active SWNT/Silica Nanohybrid Used In Enhanced Oil Recovery," SPE International, presented at the 2010 SPE Improved Oil Recovery Symposium, Apr. 26-28, 2010, 11 pages.
Wu et al., "Poly(2-acrylamide-2-methylpropanesulfonic acid)-modified Si0 2 Nanoparticles for Water-based Muds," American Chemical Society—Industrial and Engineering Chemistry Research, 56:1, Dec. 20, 2016, 7 pages.
Zhang et al., "Engineering the Unique 2D Mat of Graphene to Achieve Graphene-TiO 2 Nanocomposite for Photocatalytic Selective Transformation: What Advantage does Graphene Have over Its Forebear Carbon Nanotube?" ACS Nano, 5:9, Sep. 27, 2011, 10 pages.
Zhang et al., "TiO 2 -Graphene Nanocomposites for Gas-Phase Photocatalyptic Degradation of Volatile Aromatic Pollutant: Is TiO 2 -Graphene Turley Different from Other TiO 2 -Carbon Composite Materials?" Acs Nano, 4:12, Dec. 28, 2010, 12 pages.
Zhou et al., "Preparation of a reduced graphene oxide/zirconia nanocomposite and its application as a novel lubricant oil additive," RSC Advances, 5:111, Jan. 1, 2015, 11 pages.
Zolfaghari et al., "Preparation and characterization of nanocomposite hydrogels based on polyacrylamide for enhanced oil recovery applications," J. Appl. Polym. Sci., 2006, 100:2096-2103.
U.S. Appl. No. 17/644,144, filed Dec. 14, 2021, Sherief et al.
U.S. Appl. No. 17/644,217, filed Dec. 14, 2021, Sherief et al.
PCT International Search Report and Written Opinion in International Appln. No. PCT/US2022/052671, dated Apr. 20, 2023, 15 pages.

* cited by examiner

200

320

400

500

600

700

800

900

SELECTIVE ZONAL ISOLATION

TECHNICAL FIELD

This disclosure relates to shutoff of unwanted fluids produced from a subterranean formation into a wellbore.

BACKGROUND

A wellbore in a subterranean formation in the Earth crust may be treated. The wellbore treatments may facilitate production of hydrocarbon, such as crude oil, from the subterranean formation. A problematic section of a wellbore to be treated may be a water zone in which water enters the wellbore from the hydrocarbon formation or underlying water aquifer. The influx of water into the wellbore during production of crude oil can add cost. The production of water along with the crude oil from the hydrocarbon formation can lead to surface processing of the water and injection of the water back into the hydrocarbon formation for disposal or pressure maintenance. Such processing and injection of water produced from the wellbore water zone causes increased costs of the oil production.

In certain instances, natural gas may also be an unwanted produced fluid. Natural gas as a produced unwanted gas is generally separated and flared before the crude oil is distributed. In some operations, gas-handling capabilities are not readily available at the well site.

SUMMARY

An aspect relates to a method of treating a region of a subterranean formation adjacent a wellbore zone, the method including cooling the wellbore zone to a wellbore temperature below a temperature of the region of the subterranean formation adjacent the wellbore zone, injecting a gellable treatment composition through the wellbore zone into the region of the subterranean formation adjacent the wellbore zone, allowing the gellable treatment composition to gel in the region to prevent or reduce flow of an unwanted fluid from the region into the wellbore zone, and producing desired hydrocarbon from the region through the wellbore zone to Earth surface, wherein a gel formed from the gellable treatment composition in the region prevents or reduces production of the unwanted fluid from the region. The gellable treatment composition may be thermally activated.

Another aspect relates to a method of treating a region of a subterranean formation adjacent a wellbore zone, the method including pumping a gellable treatment composition into a wellbore comprising the wellbore zone to flow the gellable treatment composition through the wellbore zone to cool the wellbore zone to a temperature lower than formation temperature of the region of the subterranean formation adjacent the wellbore zone. The method includes pumping the gellable treatment composition into the wellbore to flow the gellable treatment composition through the wellbore zone into the region of the subterranean formation adjacent the wellbore zone to plug the region to prevent or reduce flow of an unwanted fluid from the region, and allowing the gellable treatment composition to gel in the region, thereby preventing or reducing the flow of the unwanted fluid from the region. The gellable treatment composition is heat activated.

Yet another aspect is a method of treating a region of a subterranean formation adjacent a wellbore zone, the method including pumping a gellable treatment composition through coiled tubing and the wellbore zone into the region of the subterranean formation adjacent the wellbore zone to shutoff flow of water or gas, or both, from the region into the wellbore zone. The gellable treatment composition is heat activated. The method includes controlling wellbore temperature of the wellbore zone to prevent or reduce gelling of the gellable treatment composition in the wellbore zone. The method includes allowing the gellable treatment composition to form a gel in the region, thereby providing for the shutoff of the flow of water or gas, or both.

The details of one or more implementations are set forth in the accompanying drawings and the description below. Other features and advantages will be apparent from the description and drawings, and from the claims.

DETAILED DESCRIPTION

Figure 1:
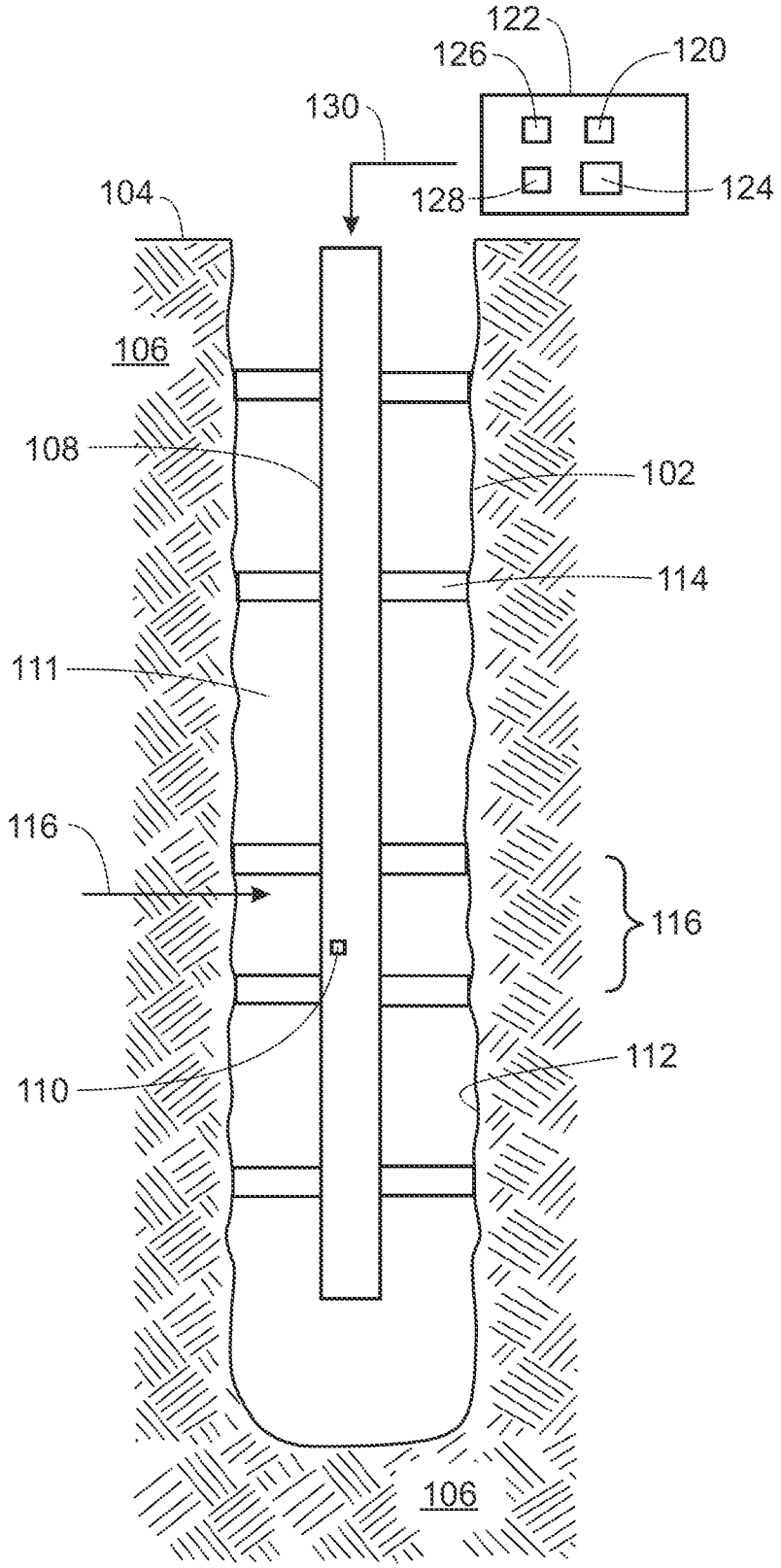
FIG. 1 is a diagram of a well site having a wellbore formed through the Earth surface into a subterranean formation in the Earth crust.

Aspects of the present disclosure are directed to a rigless technique for applying chemicals or chemical compositions for zonal isolation. The chemicals (e.g., colloidal silica, polymers, resins, etc.) transform to a solid (e.g., a gel) in response to in situ heat. These thermosetting chemicals when activated form a sealing material that can plug or damage the subterranean formation at the zone of interest for shutoff. These gellable treatment compositions are heat activated (thermally activated) via heat provided by the subterranean formation to gel the gellable treatment composition for zonal isolation. The gelling may solidify the gellable treatment composition into a hardened gel. A chemical activator (e.g., accelerator, crosslinker, gellant, gelling agent, etc.) may be included in the composition to further promote activating (gelling) of the gellable treatment composition. The gelling may include polymerization, crosslinking, etc.

The gellable treatment composition can have applicable sensitivity to temperature (and activator concentration) for gelation time to treat the subterranean formation without significant gelling (fouling) in the wellbore. The gelation time may be relatively quick at the temperature of the subterranean formation but relatively long at the temperature in the wellbore as cooled. The activator concentration can affect the gelation time. Various systems and procedures may be implemented to apply (inject) the gellable treatment composition through the wellbore into the region of the subterranean formation to be treated. A common theme among implementations can be that the wellbore is cooled, such that the wellbore temperature is less than the subterranean formation temperature.

Embodiments may include treating a region of a subterranean formation adjacent a wellbore zone. The wellbore zone is cooled to a wellbore temperature below the temperature of the region of the subterranean formation adjacent the wellbore zone. The gellable treatment composition is injected through the wellbore zone into the region of the subterranean formation adjacent to the wellbore zone. The region may be at the same or similar depth as the wellbore zone. The gellable treatment composition is allowed to gel in the region (in the formation) to prevent or reduce flow of an unwanted fluid from the region into the wellbore zone. The treatment may be characterized as shutoff of the unwanted fluid (e.g., water or natural gas). The wellbore temperature being cooler than the formation temperature may beneficially facilitate little or no gelling of the gellable treatment composition inside the wellbore during the treatment. As indicated, for the treatment, the technique may lower the wellbore temperature with respect to the surrounding formation temperature.

The gellable treatment composition can include various thermosetting chemicals that form a gel or similar solid in response to heat. The formed gel may be a hardened gel as activated (and cured in some instances). Thermosetting chemicals may denote colloidal silica, polymers (polymer gels or pre-gels), resins, and other thermosetting chemicals. These may be utilized in applications in the oil and gas industry, such as sweep conformance and control, zonal isolation including water (or gas) shutoff, and the like. Despite chemical differences among these chemical categories, the chemicals may harden in response to being subjected to heat, becoming solid and generally impermeable. The thermosetting chemicals can include thermosetting resin, thermosetting polymer, and thermosetting colloidal silica.

The gellable treatment composition can be colloidal silica compositions that form a gel in response to heat, such as those disclosed in U.S. Patent Application Publication No. 2018/0327648 A1, which is incorporated herein by reference in its entirety.

The gellable treatment composition can include polymer and polymer gel (or pre-gel) compositions that form a crosslinked polymer gel or polymer gel matrix in response to heat, such as that described in U.S. Patent Application Publication No. 2020/0408063 A1, which is incorporated herein by reference in its entirety. The polymer as a base polymer in the gellable treatment composition may be, for example, a polymer capable of crosslinking to form a crosslinked polymer matrix within the subterranean formation at the zone of interest. In some implementations, the polymer is a polyacrylamide homopolymer or a copolymer of acrylamide monomer units and acrylate monomer units, or both. The copolymer may be, for example, poly[acrylamide-co-(tert-butyl acrylate)]. Other polymers are applicable. The composition may include a crosslinker (crosslinking agent) to cure the polymer into a polymer gel (e.g., a cross-linked polymer gel matrix) in presence of heat for plugging the region of the subterranean formation being treated for shutoff. The polymer as injected at Earth surface into the wellbore may be labeled as a polymer pre-gel or polymer gel before crosslinking. The polymer as activated and crosslinked may be labeled as a polymer gel that is a cross-linked polymer gel matrix or hardened polymer gel.

In other embodiments, the gellable treatment composition can include resins that are activated to form a gel or polymer solid in response to heat. The resins are heat activated (thermally activated) into a hardened resin labeled herein as a gel (hardened gel). The term "resin" incorporated (e.g., as a pre-gel) in the gellable treatment composition may refer to an organic polymer-based material that can form a solid plastic material labeled herein as a formed gel (solid resin). Resins incorporated as the base component of the gellable treatment composition can include, for example, epoxies, phenolics, and furans. These three types of resins can undergo maturation kinetics including in response to heat to give hardened resin (gel) applicable to plug the subterranean formation for zonal isolation. An activator, such as a catalyst, caustic, or acid may be included in the composition to initiate or promote the maturation or polymerization of the resin in the presence of heat into a hardened and solid resin, as is well known by one of ordinary skill in the art. Again, the resulting resin may be labeled herein as a gel (hardened gel). Other resins as thermosetting chemicals are applicable.

The gellable treatment composition may be applied for zonal isolation and remedial interventions generally including in the annulus behind casing and/or inside the subterranean formation. The wells may be vertical, deviated, and horizontal wells. The wells may be open and/or cased hole wells and single and/or multi-lateral wells. The wells may have special completions such as pre-perforated liners (PPL), inflow control devices (ICD) with or without sliding sleeves (SSD) including with the SSD stuck or inoperable, and inflow control valves (ICV) including with the downhole valves stuck or inoperable.

Embodiments of the present techniques may overcome certain complications and risks associated with squeezing and/or pre-mature setting of sealing chemicals inside the wellbore. Immediately or soon after selective treatment with the gellable treatment composition (e.g., as water-thin slurry in some applications), the wellbore may be clear to resume operation. In implementations, the injection of the colloidal silica can be a water-thin slurry during the treatment. The polymer (polymer gel) compositions as injected can be somewhat heavier and viscous than colloidal silica. The resins as injected into the wellbore are generally denser and more viscous than both the colloidal silica and polymer as injected. In specific implementations, the pumping rate for the colloidal silica is about 2.5 barrels per minute (bpm), the pumping for the polymer gel is about 1.5 bpm, and the pumping rate for resins is in the range of 0.4 bpm to 1.0 bpm. The present techniques are not limited to these numerical values for the injection-pumping rate of the gellable treatment composition from the Earth surface into the wellbore.

The success of treatments for selective zonal isolation in subterranean formations may depend on the technique to provide the treatment fluid to penetrate deep enough into the formation to bridge or plug undesired fluid zones as quickly as possible, and resuming as soon as feasible the hydrocarbon production from remaining portions of the well. Challenges that may be encountered using traditional treatment fluids include: (1) the gelation time in relation to the time to pump the treatment volume can be too short, resulting in the risk of downhole equipment becoming stuck by solidified gel in the wellbore; and (2) the treatment volume can be too dilute or the gelation time in relation to the treatment volume to pump can be too long, resulting in the risk of the gel dissipating and/or flowing back from the formation and into the wellbore, thereby failing to bridge or plug undesired fluid zones to create the desired flow barrier.

Some examples of common downhole equipment employed to deliver conventional treatment fluid to subterranean formations include batch mixers, pumps, coiled tubing, downhole inflatable retrievable production packers, and retrievable or drillable composite plugs. In conventional treatment methods, a retrievable or drillable plug is set below the desired treatment depth, while an inflatable production packer is set above the desired treatment depth. Depending on the desired treatment depth and the specific types of plugs and packers used, the setting and unsetting of such downhole equipment may take a few hours and in some cases, up to a few days. Further, running the coiled tubing to the desired treatment depth and running it out of hole may also take several hours. Some conventional treatment methods require mixing of the treatment fluid at the surface in batch mixers, or the treatment fluid is shipped to the wellsite already mixed and at a fixed crosslinker concentration. Once ready, the treatment fluid can be pumped downhole to the desired treatment depth, for example, via coiled tubing and through the inflatable production packer. The treatment fluid can be prepared to achieve gelation after pumping and retrieving downhole equipment to avoid gluing the inflatable production packer and the coiled tubing inside the wellbore. In some cases, a residual of the treatment fluid is purposefully left inside the wellbore to avoid gel from flowing back from the formation and into the wellbore, thereby ensuring blocking of the undesired fluid zone. In such cases, obtaining access to the wellbore after completing the treatment process requires milling and cleaning of undesired solids left inside the wellbore by the treatment process. Overall, such conventional methods from beginning to end may be lengthy in time and expensive in costs, along with the carried risk of losing or damaging the wellbore in the process. Depending on the treatment volume, conventional rigless chemical shut-off treatment processes may take from days to weeks. Further, conventional rigless chemical shut-off treatment processes may require the well to be kept shut-in for some time duration after the treatment process has been completed in order to allow for the treatment to cure and form a blockage.

The subject matter described in this disclosure can be implemented so as to realize the following advantages. The treatment method for selective zonal isolation in subterranean formations described here can be implemented from beginning to end within a single day. The treatment method for selective zonal isolation in subterranean formations described here can include maintaining the wellbore at a temperature that is cooler than the temperature of the zone of interest (zone in which fluid flow is undesired and therefore the target zone for the selective isolation) throughout implementation of the treatment method. Such can mitigate, reduce, and/or eliminate the risk of downhole equipment becoming stuck within the wellbore and can mitigate and/or eliminate the risk of plugging the wellbore and losing production of valuable hydrocarbons from the well. The treatment fluid used in the treatment method for selective zonal isolation in subterranean formations described here can bridge undesired fluid zones without significant delay within the subterranean formation. The treatment method for selective zonal isolation in subterranean formations described here can be completed without requiring wellbore cleanout operations to regain access to the wellbore, unlike conventional methods. Further, the treatment method for selective zonal isolation in subterranean formations described here can be completed without requiring shutting in of the well for a time duration after delivery of the treatment fluid.

FIG. 1 is a well site 100 having a wellbore 102 formed through the Earth surface 104 into a subterranean formation 106 in the Earth crust. The subterranean formation 106 may also be labeled as a geological formation, hydrocarbon formation, hydrocarbon reservoir, etc. Hydrocarbon is produced from the subterranean formation 106 through the wellbore 102 to the surface 104. The hydrocarbon may be crude oil or natural gas, or both. To produce the hydrocarbon, the hydrocarbon may flow from the subterranean formation 106 into the wellbore 102, and then into tubing 108 (e.g., or production tubing) to flow to the surface 104. The "tubing" 108 as used herein is a generic term to include a conduit, tubing having perforations or holes, pre-perforated liner (PPL), production screens, production tubing, and the like.

In the illustrated embodiment, the hydrocarbon may flow from the formation 106 into the tubing 108 through entry components 110 disposed along the tubing 108. The entry components 110 may be, for example, holes, perforations, slots, valves, etc. The tubing 108 may be perforated tubing or perforated liner having the entry components 110 as perforations (holes) or slots. As indicated, the tubing 108 may be a conduit, production conduit, production tubing, tubing with perforations, holes, or slots, PPL, production screens, etc.

An annulus 111 in the wellbore 102 may be defined by the tubing 110 and the formation surface 112 or wellbore wall. The entry components 110 may allow for flow of fluid from the annulus 111 into the tubing 106. The entry components 110 may allow for flow of fluid (e.g., treatment fluid or treatment slurry) from the production tubing 110 into the annulus 111 and thus into the formation 106.

To form the wellbore 102, a hole is drilled into the subterranean formation 106 to generate the formation surface 112 (formation face) as an interface for the wellbore 102 with the subterranean formation 106. The formation surface 112 (wellbore wall) can be characterized as a wall of the wellbore 102. For a cased wellbore (not shown), the casing can be characterized as the wellbore 102 wall.

The wellbore 102 diameter may be, for example, in a range from about 3.5 inches (8.9 centimeters) to 30 inches (76 centimeters), or outside of this range. The depth of the wellbore 102 can range from 300 feet (100 meters) to more than 30,000 feet (9,100 meters). The wellbore 102 can be vertical, horizontal, or deviated, or any combinations thereof. Once the wellbore 102 is drilled, the wellbore 102 may be completed.

The wellbore 102 may be openhole (as depicted) or have a cemented casing (not shown). For implementations with the wellbore 102 as cased, there may be cement between the casing and the formation surface 112. Perforations may be formed through the casing and cement into the subterranean formation 106 to facilitate or provide for hydrocarbon production from the subterranean formation 106 into the wellbore 102. In implementations, the perforations through the casing and cement may also accommodate the injection of fluids (e.g., including treatment compositions) from the wellbore 102 into the subterranean formation 106.

The wellbore 102 may be completed with multiple completion packers 114 disposed along the depth of the wellbore 102. The packers 114 may support the tubing 108 (e.g., support the weight of the tubing 108) and generally prevent or reduce movement of the tubing 108. The packers 114 may mechanically isolate sections of the annulus 111 between the tubing 108 and the formation surface 112. The packers 114 may be downhole devices installed in wellbore completions for isolation to facilitate control of production, injection, or treatment. The packers 114 (in isolating sections of the annulus 111) may separate the wellbore 102 into multiple zones (e.g., producing zones).

In the illustrated embodiment, the particular zone 116 (e.g., a producing zone) is a problematic zone in that a significant amount of unwanted fluid 118 enters the wellbore 102 from the subterranean formation 106. The zone 116 may be defined by the adjacent upper completion packer 114 and the adjacent lower completion packer 114. In implementations, the unwanted fluid 118 may be the majority of the total fluid that enters the wellbore 102 from the subterranean formation 106 at the zone 116. The total fluid that enters the wellbore 102 may be a combination of desired fluid (e.g., crude oil) and the unwanted fluid 118.

In some implementations, the unwanted fluid 118 is water and thus the zone 116 may be labeled as a water zone. Excessive water production from hydrocarbon-producing wells can adversely affect the economic life of the well. Unwanted water production can unfavorably influence well economics owing to handling of the produced water, reduction of hydrocarbon production, and environmental concerns.

In certain implementations, the fluid 118 may be natural gas that is unwanted because the well site 100 prefers production of crude oil and may not have surface facilities to collect and distribute the natural gas as product. Natural gas as a produced unwanted gas is generally separated and flared before the crude oil is distributed.

In embodiments, a gellable treatment composition 120 that is thermally activated downhole in the formation into a gel is applied to plug the subterranean formation 106 at the wellbore zone 116 to reduce or prevent the flow of the unwanted fluid 118 into the wellbore 102. This treatment may isolate the formation 106 at the wellbore zone 116 from the wellbore 102. The treatment can be characterized as selective zonal isolation. This treatment of the formation 106 at the wellbore zone 116 may be characterized as shutoff of the unwanted fluid 118. For instances of the unwanted fluid 118 as water, the shutoff via the treatment may be labeled as water shutoff. For instances of the unwanted fluid 118 as gas (e.g., natural gas), the shutoff via the treatment may be labeled as gas shutoff.

Advantageously, the gelation time of the gellable treatment composition 120 at a cooled wellbore temperature (e.g., at least 50° F. lower than the formation 106 temperature) can be at least 24 hours, at least 3 days, at least one week, or at least one month. Therefore, in implementations, the formation 106 can be treated with the gellable treatment composition 120 with little or no gelling (solidifying) of the gellable treatment composition 120 in the wellbore 102. Accordingly, the downhole devices 126 as lowered from the surface 104 into the wellbore 102 and utilized downhole to apply the gellable treatment composition 120 may be removed from the wellbore 102 without drilling the downhole devices 126. For implementations in which the gellation time at the cooled wellbore temperature is shorter than desired, the wellbore can be flushed with a version of the gellable treatment composition that is dilute in the thermosetting chemical and/or activator after the main treatment stage(s) to avoid solidifying of the gellable treatment composition 120 in the wellbore 102.

Advantageously, in implementations, the gelation time of the gellable treatment composition 120 in the formation 106 at the formation temperature (e.g., at least 50° F. greater than the cooled wellbore 102 temperature) can be less than 15 minutes, less than 1 hour, less than 2 hours, less than 3 hours, less than 4 hours, or less than 6 hours. Therefore, in implementations, the wellbore 102 may be beneficially generally available to place back into service for producing hydrocarbon within a relatively short period of time (e.g., less than 6 hours, less than 8 hours, or less than 12 hours) after completion of pumping the gellable treatment composition 120 through the wellbore 102 into the subterranean formation for the treatment. In implementations, the wellbore 102 may be generally available to place back into service, for example, within 1 hour, within 2 hours, or within 3 hours after removing the downhole treatment devices 126 from the wellbore 102.

The gellable treatment composition 120 as pumped from the surface 104 into the wellbore 102 may be labeled as a pre-gel or a precursor composition for a gel, or as a thermosetting material (e.g., polymer) that forms a gel, and the like. The gellable treatment composition 120 may include a chemical activator to promote (along with increasing temperature) the forming of the gel from the gellable treatment composition 120. The activator may increase the rate of formation of the gel. In other words, the presence of the activator may decrease the amount of time for the treatment composition 120 to gel at a given gelling temperature.

In certain implementations, the gellable treatment composition 120 is a treatment slurry having colloidal silica (silica nanoparticles) and liquid. The liquid may be a solvent or carrier fluid. The liquid may also include the activator. In other implementations, the gellable treatment composition 120 includes a polymer and a crosslinker. The polymer is a polymer that is capable of crosslinking to form a crosslinked polymer matrix within the subterranean formation at the zone 116 of interest. In some implementations, the polymer is a polyacrylamide homopolymer, a copolymer of acrylamide monomer units and acrylate monomer units, or a combination of these. In yet other implementations, the gellable treatment composition 120 may include resins. The activator in the composition 120 for the resin may include, for example, catalyst, acid, or caustic (e.g., sodium hydroxide).

Embodiments may treat the wellbore zone 116 to plug porosity or fractures in the region of the subterranean formation 106 adjacent the zone 116 to prevent or reduce the flow of unwanted fluid 118 into the wellbore 102. The treatment may involve injection of the gellable treatment composition 120 into the wellbore 102 to the zone 116 of interest (and into the formation 106 at the zone 116).

The gellable composition 120 is thermally activated via formation 106 temperature into a gel (e.g., hardened gel from thermosetting chemicals, such as colloidal silica, polymer gel, resin, etc.). At the wellbore zone 116, the gel may damage (e.g., plug the porosity of) the formation face 112 and the near wellbore region of the subterranean formation 106. Such may reduce or prevent the flow of the unwanted fluid 118 into the zone 106, which stops or reduces the influx of the unwanted fluid 118 into the wellbore 102. The gellable treatment composition 120 may be activated, via the chemical activator in the composition 120, into a gel at a temperature (e.g., formation 106 temperature) greater than surface 104 ambient temperature. The composition 102 may gel at formation 106 temperature and with the chemical activator acting as an accelerator of the gelling, crosslinker for the gelling, or promoting polymerization for the gelling, and the like.

The gellable treatment composition 120 may be held as a pre-gel or uncured gel in a vessel of surface equipment 122 at the surface 104 and then introduced (e.g., via a pump 124 of the surface equipment 122) into the wellbore 102. As indicated, the gellable treatment composition 120 as held in the surface vessel may include a chemical activator that promotes gelling at gelling temperature. Again, the activator may be an accelerator (e.g., salt), crosslinker, catalyst, acid, etc. In some implementations, the gellable treatment composition 120 as held in the surface vessel is a colloidal silica dispersion in solvent and having a chemical activator, such as a salt. In other implementations, the gellable treatment composition 120 held in the surface vessel includes a polymer and the activator as a crosslinker. The polymer is capable of crosslinking to form a crosslinked polymer matrix within the subterranean formation at the zone 116 of interest. The polymer may be, for example, polyacrylamide homopolymer or a copolymer of acrylamide monomer units and acrylate monomer units. The crosslinker may be, for example, polyethyleneimine or other crosslinker. In yet other implementations, the gellable treatment composition 120 held in the surface vessel is may include resins. The activator in the composition 120 for the resin may include, for example, catalyst, acid, or caustic (e.g., sodium hydroxide).

The gellable treatment composition 120 may be introduced (e.g., pumped) into the wellbore 102. The gellable treatment composition 120 may be pumped by a surface pump 124 of the surface equipment 122 at the surface 104. The pump(s) 124 can be skid-mounted in some instances. The pump 124 may be a centrifugal pump, positive displacement (PD) pump, reciprocating PD pump such as a piston or plunger pump, and so on. In implementations, the treatment composition 120 is pumped through coiled tubing into the tubing 108 in the wellbore 102.

The surface equipment 122 at the Earth surface 104 may include equipment (e.g., vessels, piping, pumps, wellhead, etc.) to support operations at the well site 100 including the production of hydrocarbon (e.g., crude oil) via the wellbore 102 from the subterranean formation 106. The surface equipment 122 may include equipment for drilling, installing casing, cementing casing, and so forth.

The surface equipment 122 may include equipment to treat the wellbore 102, such as the pump(s) 124, downhole devices 126 (to be applied), a deployment extension such as coiled tubing 128 (e.g., to deploy the downhole devices 126 and flow the treatment composition 120), etc. The surface dispenser of the coiled tubing 128 at the surface 104 may be a coiled tubing reel (e.g., mounted on a vehicle).

In the oil and gas industries, coiled tubing generally refers to a metal pipe supplied spooled on a reel. The coiled tubing may be employed for interventions in oil and gas wells. The coiled tubing may be a flexible steel pipe that is inserted into a wellbore to convey well servicing tools and to flow fluids or slurries. In implementations, the coiled tubing may be constructed of strips of steel rolled and seam welded. The tubing may be flexible to be coiled onto a reel, and with diameters in the range, for example, of ¾ inch to 3½ inch, or 1 inch to 3¼ inch.

The downhole devices 126 may be lowered into the wellbore 102 via a deployment extension (e.g., wireline, slickline, coiled tubing 128, etc.). The deployment extension from the Earth surface 104 at the wellbore 102 may lower or deploy a downhole device 126 into the wellbore 102. Thus, some downhole devices 126 may be deployed or lowered into the wellbore 102 via a wireline or coil tubing 128. In implementations, deployment and retrieval of the downhole devices 126 may be a rigless operation such as via wireline, slickline, coiled tubing, and the like. A rigless operation may be a well intervention conducted with equipment and support facilities that preclude the requirement for a rig over the wellbore.

The surface equipment 122 may include the aforementioned downhole devices 126 to be deployed into the wellbore 102 for treatment of the wellbore 102 including facilitating application of the gellable treatment composition 120 to the zone 116 of interest. In implementations, the downhole devices 126 may be deployed via the coiled tubing 128 or other similar deployment extension. Thus, the application of the gellable treatment composition 120 to the wellbore 102 may be a rigless operation.

The (1) use of the coiled tubing 128 (into tubing 108), (2) deployment of the downhole devices 126 (into tubing 108) via the coiled tubing 128, and (3) introduction of the gellable treatment composition 120 through the coiled tubing 128 in the tubing 108 are indicated by reference numeral 130.

The devices 126 may include, for example, a retrievable bridge plug to be deployed (e.g., via coiled tubing 128) inside the tubing 108 to the lower completion packer 114 at the zone 116. The retrievable bridge plug may isolate the tubing 108 from further downhole in preventing downhole flow through the tubing 108 pass the depth of the lower completion packer 114 at the zone 116. The devices 126 may include, for example, a retrievable production packer to be deployed (e.g., via coiled tubing 128) inside the tubing 108 to the upper completion packer 114 at the zone 106. The retrievable production packer may direct the gellable treatment composition 120 (pumped from the surface 104 through the coiled tubing 126) into the zone 106. The treatment composition 120 may discharge from the coiled tubing in the tubing 108 at the zone 116 and flow through entry components 110 into the annulus 111 in zone 116.

At the zone 106 (annulus 111 isolated via packers 114), the gellable treatment composition 120 may flow from the annulus 111 into the subterranean formation 106. The motive force for flow of the treatment composition 120 may be provided by the surface pump 124. The treatment composition 120 as applied may gel in the formation 106, such as in the near wellbore region at the depth of the zone 106. The gel may foul (plug porosity) of the subterranean formation 106 in this near wellbore region at the zone 116 depth to stop or reduce the flow of the unwanted fluid 118 into the wellbore 102. The plugging of the formation face 112 and near wellbore region of the subterranean formation 106 at the wellbore zone 116 with the gel may isolate the zone 116 from the wellbore 102 and from contributing to production through the tubing 108 to the surface 104.

In embodiments, no shut-in of the well (of the wellbore 102) is implemented in the treatment with the gellable treatment composition 120 including for gelling of the composition 120. After treatment, the downhole devices 126 (e.g., retrievable bridge plug and retrievable production packer) may be raised (e.g., via the coiled tubing 128) from the wellbore 102 to the surface 104, and the wellbore 102 placed in service for production of hydrocarbon from the subterranean formation 106 to the surface 104. Such removal of the downhole devices 126 may be implemented in less than 1 hour, less than 2 hours, less than 3 hours, or in a range of 1 hours to 3 hours after treatment (e.g., after completion of pumping the gellable treatment composition 120 into the wellbore 102). In embodiments, the downhole devices 126 (e.g., retrievable bridge plug and retrievable production packer) are not drilled for removal because generally little or no significant gelling occurred in the wellbore 102 in implementations.

After completion of pumping the gellable treatment composition 120 into the wellbore 102, the downhole devices 126 (e.g., retrievable bridge plug and retrievable production packer) may be available for removal, for example, essentially immediately (e.g., less than 5 minutes) or within 4 hours (or within 8 hours), depending on the application. Of course, the timing of when the retrievable the downhole devices 126 can be retrieved from the wellbore may depend on the particular application including equipment vendor and type, contractor personnel, logistics, etc.

The gellable treatment composition 120 as applied to (injected into) the formation 106 should be generally be gelled in the formation 106 before production is started, so that the gellable treatment composition 120 is not produced from the formation 106 back into the wellbore 102. In certain implementations, the gellable treatment composition 120 (or the bulk or majority of the gellable treatment composition 120) in the formation 106 may be cured essentially immediately (e.g., less than 10 minutes) or within a few minutes (e.g., less than one hour or less than 2 hours) or within a few hours (e.g., less than 3 hours, less than 5 hours, or less than 8 hours) after pumping of the gellable treatment composition 120 into the wellbore 102 has ended. In some implementations, the gellable treatment composition 120 (or the bulk or majority of the gellable treatment composition 120) in the formation 106 may be cured at the time that pumping of the gellable treatment composition 120 into the wellbore has ended.

In example scenarios, the downhole devices 126 (retrievable downhole treatment equipment) are removed within 4 hours (or within 8 hours) of completing pumping of the gellable treatment composition 120 into the wellbore 102, and the wellbore is placed into production hydrocarbon within 12 hours (or within 18 hours) after completing pumping of the gellable treatment composition 120 into the wellbore 102. However, the present techniques are not limited to these example numerical values for time.

As discussed, the wellbore 102 may be openhole without casing or liner. For embodiments with the wellbore 102 as a cemented cased wellbore with or without the presence of completion packers 114, a downhole device 126 deployed to apply the gellable treatment composition 120 may be, for example, a straddle packer. The straddle packer may be deployed (e.g., via coiled tubing 128) to mechanically isolate a wellbore zone of interest (e.g., water zone, gas zone, etc.). In these implementations, the gellable treatment composition 120 may be pumped via pump 124 through coiled tubing 128 to the straddle packer and ejected from a nipple on the straddle packer into the zone. The zone may be mechanically isolated by the straddle packer the upper and lower inflatable elements of the straddle packer. The gellable treatment composition 120 as ejected by the straddle packer nipple may flow through the perforations through the cemented casing into the subterranean formation 106. The motive force for flow of the composition 120 through the perforations into the subterranean formation 106 may be provided by the pump 124.

The composition 120 generally does not form a hardened gel until the composition 120 reaches the downhole location and at a certain temperature. The gellable treatment composition 120 may be held in a vessel at the surface 104 prior to treatment application and then pumped into the wellbore 102. The pumped composition 120 may penetrate into porous sediments or fissures of the subterranean formation 106, which then gels and hardens in the presence of the activator to create a barrier. In implementations, the activator can cause or facilitate a reaction, resulting in the formation of a gel in the formation 106 at the zone 116. In embodiments, an increase in concentration of the activator in the composition 120 can decrease the gelling time.

The gellable treatment composition 120 as held in a vessel at the surface 104 prior to treatment application and as pumped into the wellbore 102 may be a dispersion (e.g., aqueous dispersion) of colloidal silica (particles) in a fluid (e.g., water) and including an activator (e.g., a salt). The activator employed may be called an accelerator. The fluid can be a solvent, such as water, isopropyl alcohol, methylethylketone (MEK), N,N-dimethylformamide (DMF), and N,N-dimethylacetamide (DMAC). The solvent may be a Bronsted base solvent that gives a dispersion stable against agglomeration of the colloidal silica.

The composition 120 can include the colloidal silica and the accelerator (along with the solvent) to form a gel that can be utilized for water and/or gas shut-off applications in subterranean zones. In some embodiments, the compositions 120 with the colloidal silica penetrate into porous sediments or fissures of the subterranean formation 106, which then gels and hardens in the presence of the activator to create a barrier. In implementations, the activator can cause or facilitate a reaction between the colloidal silica particles (e.g., modified silica particles) in the composition 120, resulting in the formation of a gel in the formation 106 at the zone 116. In implementations, the gelling time for the gellable treatment composition 120 to form (convert into) a gel is 0.5 hour to 24 hours at a temperature in a range of 90° C. to 200° C. In implementations, the gelling time is less than 2 hours at a temperature of at least 120° C. For particular implementations, the gelling time is less than 1 hour at formation 106 temperatures greater than 120° C. In embodiments with the composition 120 as a colloidal silica composition, an increase in concentration of the activator in the composition 120 can decrease the gelling time.

The colloidal silica may be amorphous silica ($SiO_2$) particles having a diameter in a range of 1 nanometer (nm) to about 150 nm. The colloidal silica can be surface modified. For example, the colloidal silica can be an organosilane-modified colloidal silica, which can be referred to as organosilane-functionalized colloidal silica. In some embodiments, the organosilane-functionalized colloidal silica is formed from a reaction between an organosilane reactant and one or more silanol groups on the silica surface of the colloidal silica. Thus, the colloidal silica in the composition 120 may include colloidal silica particles in which at least a portion of the surface silanol groups are replaced with a chemically bound organosilane group(s).

In the composition 120 as a colloidal silica dispersion (e.g., aqueous dispersion), the activator may be a salt, such as an organic salt or an inorganic salt, or a combination thereof. The salt may be, for example, sodium silicate, potassium silicate, sodium chloride, or sodium hydroxide, or any combinations thereof. Thus, the composition 120 may include at least one salt cation. The pH of the composition 120 may be in the range of 6 to 11, or in range of 9 to 11. The composition 120 may include, for example, the activator in a range of 1 weight percent (wt %) to 30 wt % and a silica content in a range of 3 wt % to 55 wt %, expressed as wt % of the non-functionalized silica. For disclosure of examples of colloidal silica dispersions with activator (accelerator) as applicable to be the gellable treatment composition 120, see U.S. Patent Application Publication No. 2018/0327648 A1.

The composition 120 generally does not form a gel or hardened gel until the composition 120 reaches the downhole location and at a certain temperature. In implementations, the gelling time of the gellable treatment composition 120 as colloidal silica dispersed in solvent with activator can be controlled. The gelling time can be sensitive to the amount of activator salt, especially under high temperature conditions typically experienced in subterranean oil and gas wells. In some embodiments, control of gel times can be achieved by specifying a concentration of the activator in the composition 120, or tailoring the ratio of the activator to the colloidal silica in the composition 120. In implementations, the rate of gelation of the composition 120 is controlled by the amount of activator and the amount of modified colloidal silica in the composition. In embodiments, the colloidal silica (or modified colloidal silica) as nanoparticles may be labeled as nanosilica (NaSil).

The gellable treatment composition 120 as held in a vessel at the surface 104 prior to treatment application and as pumped into the wellbore 102 may include polymer, as discussed, instead of NaSil. The polymer may be capable of forming crosslinked polymer matrix as a polymer gel. In these embodiments, the gellable treatment composition 120 can solidify to form a gel, thereby creating a solid barrier that prevents fluid flow and therefore effectively shuts off the water breakthrough. In these embodiments for the polymer gel, the gellable treatment composition 120 includes a polymer and an activator that is a crosslinker. Again, the polymer is capable of crosslinking to form a crosslinked polymer matrix within the zone 116 of interest. In some implementations, the polymer is a polyacrylamide homopolymer or a copolymer of acrylamide monomer units and acrylate monomer units, or a combination of these. In some implementations, the copolymer of acrylamide monomer units and acrylate monomer units is poly[acrylamide-co-(tert-butyl acrylate)] (PAtBA), which is provided in structural formula (I).

(I)

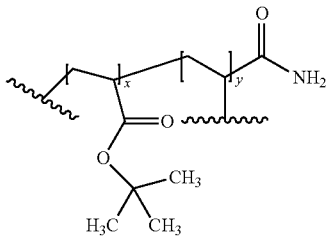

PAtBA

In structural formula (I), x is the number of tert-butyl acrylate monomer units, and y is the number of acrylamide monomer units. The polymer has an average molecular weight sufficient, such that when the polymer is crosslinked by the crosslinker, the resulting crosslinked polymer gel reduces or prevents the flow of fluids (such as water or water-containing fluids) through the gel, for example, formed in the zone 116 of interest. The base polymer may include polyacrylamides or polyimide acrylates, or both. The base polymer may have an average molecular weight of from 250,000 to 500,000 grams per mole.

The crosslinker is a crosslinker that is capable of crosslinking the polymer to form a crosslinked polymer matrix within the zone 116 of interest. In some implementations, the crosslinker is an organic crosslinker. In some implementations, the crosslinker includes an imine functional group. In some implementations, the crosslinker is polyethyleneimine. The polyethyleneimine can be a linear polyethyleneimine or a branched polyethyleneimine. The crosslinker has an average molecular weight sufficient to crosslink the polymer to produce a crosslinked polymer gel within the zone of interest 110.

In some implementations for the polymer gel, the gellable treatment composition 120 (having the polymer and crosslinker) includes an adsorption system. The adsorption system may increase the adhesion of the crosslinked polymer gel to a rock surface of the pores of the subterranean formation at the zone 116 of interest. The adsorption system may include a silane compound or a silane compound and a silicate component. Thus, the adsorption system has a silane. The adsorption system may have silicate, such as sodium silicate or potassium silicate, or both.

With these embodiments for the gellable treatment composition 120 having the polymer and crosslinker to give the polymer gel, the gellable treatment composition 120 may have a pH of in the range of 9 to 14, and prior to injection into the zone 116 of interest, have a viscosity in a range of 5 centipoise (cP) to 10 cP prior to injection.

The gellable treatment composition 120 having the polymer and crosslinker may also include an additive. Some examples of suitable additives include salts, fillers, organic compounds, preservatives, and rheology modifiers. Salts may be added to the gellable treatment composition 120 to reduce or prevent clay swelling in the subterranean formation. Some examples of salts include alkali metal chlorides, hydroxides, and carboxylates. The salts included in the gellable treatment composition 120 can include sodium, calcium, cesium, zinc, aluminum, magnesium, potassium, strontium, silicon, lithium, ammonium, chlorides, bromides, carbonates, iodides, chlorates, bromates, formats, nitrates, sulfates, phosphates, oxides, fluorides, or any combination of these. For example, the gellable treatment composition 120 can include calcium chloride, ammonium chloride, potassium chloride, or any combination of these. In some implementations for the polymer gel, the gellable treatment composition 120 can include filler particles, such as silica particles.

As mentioned previously, the gellable treatment composition 120 solidifies to form a gel. For the polymer gel embodiments, the gellable treatment composition 120 includes the activator as a crosslinker. The crosslinker is configured to cause or facilitate reactions that cause the polymer to crosslink, resulting in formation of a gel. The polymer can react with the crosslinker to transform into a crosslinked polymer gel. Therefore, the crosslinker can cause the formation of the gel. In some implementations, the crosslinker is configured to cause the polymer to crosslink and result in an increased viscosity of the gellable treatment composition 120. For example, transition of the polymer from a flowable liquid to a crosslinked gel may include formation of covalent bonds between individual polymers via crosslinking reactions, which may build viscosity in the gellable treatment composition 120. The concentration of crosslinker in the gellable treatment composition 120 can depend on the temperature of the subterranean formation at the zone of interest. In some implementations, the concentration of crosslinker in the gellable treatment composition 120 is in a range of from about 0.3 weight percent (wt %) to about 2 wt %.

As used in this disclosure, the term "gelation time" when used in the context of the gellable treatment composition 120 with polymer and crosslinker to give polymer gel, may refer to a time duration between a first time at which the crosslinker is introduced to the polymer and a second time at which the polymer has crosslinked to form the crosslinked polymer gel capable of reducing or preventing the flow of fluids through the gel. In implementations, the gellable treatment composition 120 (having the polymer and crosslinker) at a temperature of 120° C. can have a gelation time in the ranges of 1 hour to 48 hours. In some implementations, the gelation time of the gellable treatment composition 120 can be controlled. In implementations, control of gelation times can be achieved by tailoring the ratio of the polymer to crosslinker in the gellable treatment composition 120. The implemented ratio may depend on the nature of the polymer and/or the crosslinker, and on the conditions and type of the porous rock formations that are involved.

An example of the gellable treatment composition 120 having the polymer (base polymer) and crosslinker in water as stored at the surface 104 may include the polymer in a range of 3 wt % to 10 wt %, crosslinker (e.g., polyethyleneimine) in a range of 0.3 wt % to 2.0 wt %, and the silane (e.g., amino-silane) in a range of 3 wt % (or 5 wt %) to 10 wt %. This example of the gellable treatment composition 120 may include silicate, such as sodium silicate or potassium silicate, or both. The polymer (base polymer) may have an average molecular weight of from 250,000 to 500,000 grams per mole. This example of the gellable treatment composition 120 may have an initial viscosity in a range of 5 cP to 10 cP at surface atmospheric conditions and before crosslinking of the polymer.

Whether the gellable treatment composition 120 is a colloidal silica composition, a polymer composition, a resin composition, or other thermosetting chemical composition, the gelation process may be activated by the formation temperature. In some implementations, the formation temperature is the temperature inside the desired location (zone of interest) in the subterranean zone. The in situ gelation may take place to plug (partially or completely) pore spaces, thereby limiting undesired water and/or gas production. In implementations, the internal volume of the formation into which the gellable treatment composition 120 is flowed is substantially plugged by the gel that forms within the formation. The substantial plugging may result in fluid in the formation (for example water, gas, or other fluid) not being able to escape into the wellbore 102. In some implementations, the chemical concentration or the quantity of crosslinker (or both) can be used to control gelation time, thereby allowing a predictable and controllable pumping time, ranging from a few minutes to several hours at a given temperature.

With conventional methods and conventional treatment fluids, there is a risk that the downhole tools (such as the coiled tubing, the bridge plug, and the production packer) will get stuck as the treatment fluid solidifies within the zone of interest. If that happens, the wellbore 102 becomes plugged and can result in a complete loss. The methods and gellable treatment composition 120 described in this disclosure can be implemented, such that downhole equipment can be retrieved immediately after squeeze operations (or soon thereafter) and therefore reduce and/or eliminate the aforementioned risk. The methods and gellable treatment composition 120 described in this disclosure can be implemented, such that production from the wellbore 102 can be continued immediately after the treatment method has been completed without the need to shut in the wellbore 102, which can minimize costs and production downtime. The methods and gellable treatment composition 120 described in this disclosure can be implemented, such that cleaning operations (such as milling) to remove solid residuals or to regain access to partially or completely blocked portion(s) of the wellbore 102 is not necessary, which can also reduce costs and production downtime.

The composition 120 generally does not form a gel until the composition 120 reaches the downhole location and at a certain temperature. In implementations, the gelling time of the gellable treatment composition 120. The gelling time can be sensitive to the amount of activator, especially under high temperature conditions typically experienced in subterranean oil and gas wells. In some embodiments, control of gel times can be achieved by specifying a concentration of the activator in the composition 120.

Undesired fluids production may partially impair well productivity and may lead to complete loss of production. An example is presented in FIG. 2 where oil production is impaired by gas and water breakthrough from some challenging locations such as the well-heel or middle section. During the oil production operation, the gas and/or water breakthrough reduces the well oil deliverability and increases the operational costs to separate and dispose any undesired byproducts such as gas and water. Blockage of undesired fluids in such cases will therefore improve well productivity and reduce operational costs, and consequently may give a reduction of the carbon footprint.

This situation can be remediated by isolating the interval where the undesired fluid enters the wellbore. Isolation or shut-off can be achieved by in-situ thermally setting chemicals, such as colloidal silica, polymer gels and/or resins (e.g., permanent resins). The treatment slurry (gellable treatment composition) can be squeezed by coil tubing (CT) at the desired zone after setting a (1) retrievable bridge plug (RBP) and a (2) retrievable production packer (RPP). Once the treatment fluid is exposed to the reservoir (formation) temperature, the treatment will solidify creating a solid flow barrier as presented in FIG. 3A. In conventional applications with thermosetting chemicals pose significant risks since conventional applications keep the well shut-in after the squeeze for some time until those compounds can solidify with excess inside the wellbore to avoid flowback of treatment fluid (prior to solidifying) from the formation into the wellbore. During that time, the downhole tools including the CT, RPP, and RBP still inside the wellbore will be fouled by residual thermosetting chemicals solidifying inside the wellbore especially between RPP and RBP while awaiting for the solid flow barrier to form inside the subterranean zone. In such situation, the well is practically plugged and lost.

In contrast, embodiments herein include deployment techniques that mitigate the aforementioned risks. Downhole equipment can be retrieved immediately after squeeze operations. The plug is formed inside the formation leaving the treated zone isolated by the time gellable treatment composition is squeezed. The well can be flowed and produced immediately after treatment and no need for shut-in time. The wellbore is left clear and cleaning operations involving milling of solid residuals is generally not required. Examples of these techniques were successfully implemented in the field utilizing different types of thermosetting chemicals by adjusting (1) pumping schedule (pumping rate, stage volumes and total pumping duration); (2) activator or crosslinking material concentration; and (3) pumping rate to control the wellbore temperature. See, for example, FIG. 4A and FIG. 4B.

Figure 2:
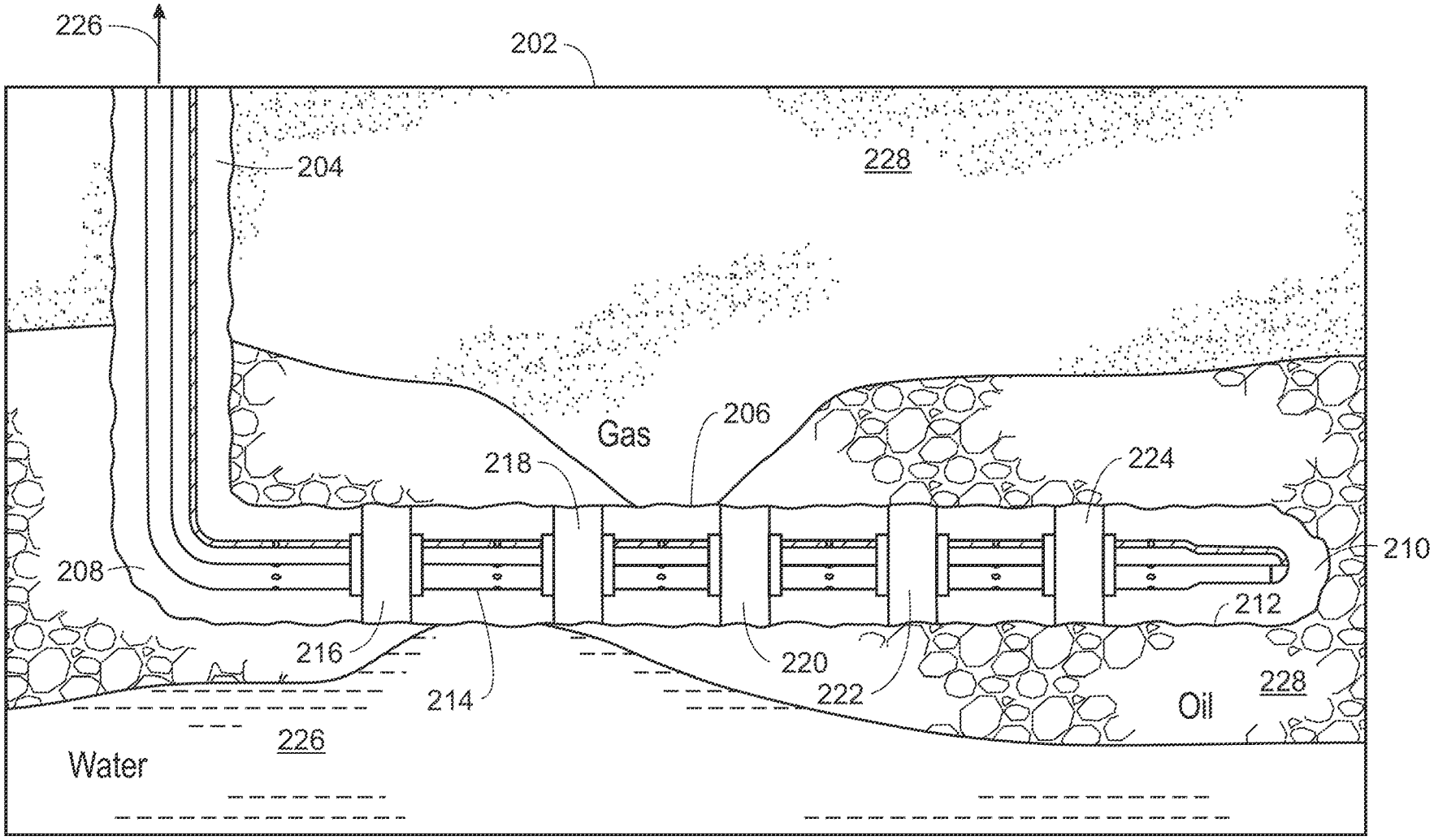
FIG. 2 is a diagram of a wellbore formed in a subterranean formation in the Earth crust.

FIG. 2 is a wellbore 200 formed in a subterranean formation 202 in the Earth crust. As discussed below, water breakthrough (and gas breakthrough) from the subterranean formation 202 into the wellbore 200 are represented.

The wellbore 200 has a vertical portion 204 (vertical segment) and a horizontal portion 206 (horizontal segment). At the well heel 208 (wellbore heel), the wellbore 200 transitions from the vertical portion 204 to the horizontal portion 206. The conclusion (end portion) of the horizontal portion 206 may be called a well toe 210.

The wellbore 200 is depicted as openhole, e.g., an openhole wellbore (not cased). The wellbore 200 has a formation face 212 that is the wellbore wall of the wellbore 200. The wellbore 200 includes tubing 214 (e.g., production tubing). The tubing 214 may be a perforated or slotted tubing (or liner), and may have inflow devices. The tubing 214 may be analogous to the tubing 108 of FIG. 1. The tubing 214 may be a conduit, production conduit, production tubing, tubing with perforations, holes, or slots, a pre-perforated liner (PPL), production screens, etc. The wellbore 200 has an annulus between the tubing 214 and the formation face 212.

The horizontal portion 206 of the wellbore 200 has completion packers 216, 218, 220, 222, and 224 that divide the annulus into zones (sections). The annulus zones (production zones) are isolated from each other via the completion packers. The completion packers 216, 218, 220, 222, and 224 do not prevent flow through the tubing 214. The completion packers 216, 218, 220, 222, and 224 as openhole packers for annular isolation may typically be installed in (part of) the original well completion. Their function may be to segment the wellbore (annular barrier between segments). In FIG. 2, segments are thus formed by the completion packers with flow of formation fluid into the wellbore 200 at the segments, and with production screens, perforations, inflow devices, valves, or ports that allow the flow of formation fluid into the tubing 214.

During production, fluid flows from the subterranean formation 202 into the wellbore 200 and into the tubing 214 through the perforations, slots, valves, etc. along the tubing 214. The produced fluid flows through the tubing 214 to the Earth surface. The direction of the Earth surface is indicated by arrow 226. In operation, the desire is to produce crude oil, such as from the oil reservoir 228 of the formation 202. The crude oil from the oil reservoir 228 is produced through the tubing 214 in the wellbore 200 to the Earth surface.

In the illustrated implementation, water (an undesired produced fluid) enters the wellbore 200 from the water aquifer 230 of the subterranean formation 202. The water enters between the completion packer 216 and the completion packer 218. Thus, the wellbore length between the completion packer 216 and the completion packer 218 as a wellbore producing zone may be called a water zone of the wellbore 200.

The subterranean formation 202 also includes a gas portion 228 that may be porous rock having gas, such as natural gas, in the rock pores. Gas (e.g., natural gas), which may be an undesired produced fluid, enters the wellbore 202 from the gas portion 228. In particular, the produced gas enters between the completion packer 218 and the completion packer 220. Thus, the wellbore producing zone as the wellbore length between the completion packer 218 and the completion packer 220 may be called a gas zone of the wellbore 200.

The wellbore 202 temperature may be the temperature of tubing and fluids in the wellbore. The wellbore 202 temperature can vary along the depth of the wellbore 202. The wellbore 202 temperature of interest may be the wellbore temperature at the zone of interest (the zone to be treated). A zone of interest for the wellbore 202 may be the water zone. A zone of interest for the wellbore 202 may also be the gas zone. The term "wellbore temperature" as used herein may refer to the wellbore temperature at a zone of interest, such as a zone to be treated for shutoff.

Undesired fluids production may partially impair well productivity and may lead to substantial or complete loss of desirable production (e.g., crude oil). In FIG. 2, oil production may be impaired by gas and water breakthrough, such as from locations including near the well heel 208 or near the middle section of the horizontal portion 206 of the wellbore 200. During the oil production operation, the gas and/or water breakthrough may reduce the well oil deliverability and increase the operational costs to separate and dispose undesired byproducts, such as gas and water. In response, blockage of undesired fluids in such cases may generally therefore improve well productivity and reduce operational costs, and consequently potentially reduce the carbon footprint of the well site.

In certain instances, the ingress of unwanted produced fluids may be remediated (blocked) by isolating the interval where the undesired fluid enters the wellbore 200. In implementations, isolation or shut-off may be achieved with application of a gellable treatment composition. The gellable treatment composition may be a thermosetting chemical, such as NaSil, polymer (to give polymer gel), resins, and so forth. Some implementations may employ NaSil compositions, such as those described in the aforementioned US Published Patent Application No. 2018/0327648 A1. Gellable treatment compositions having thermosetting chemicals other than NaSil compositions may be applied, such as resins, or the polymer compositions describe in U.S. Patent Application Publication No. 2020/0408063 A1.

Figure 3A:
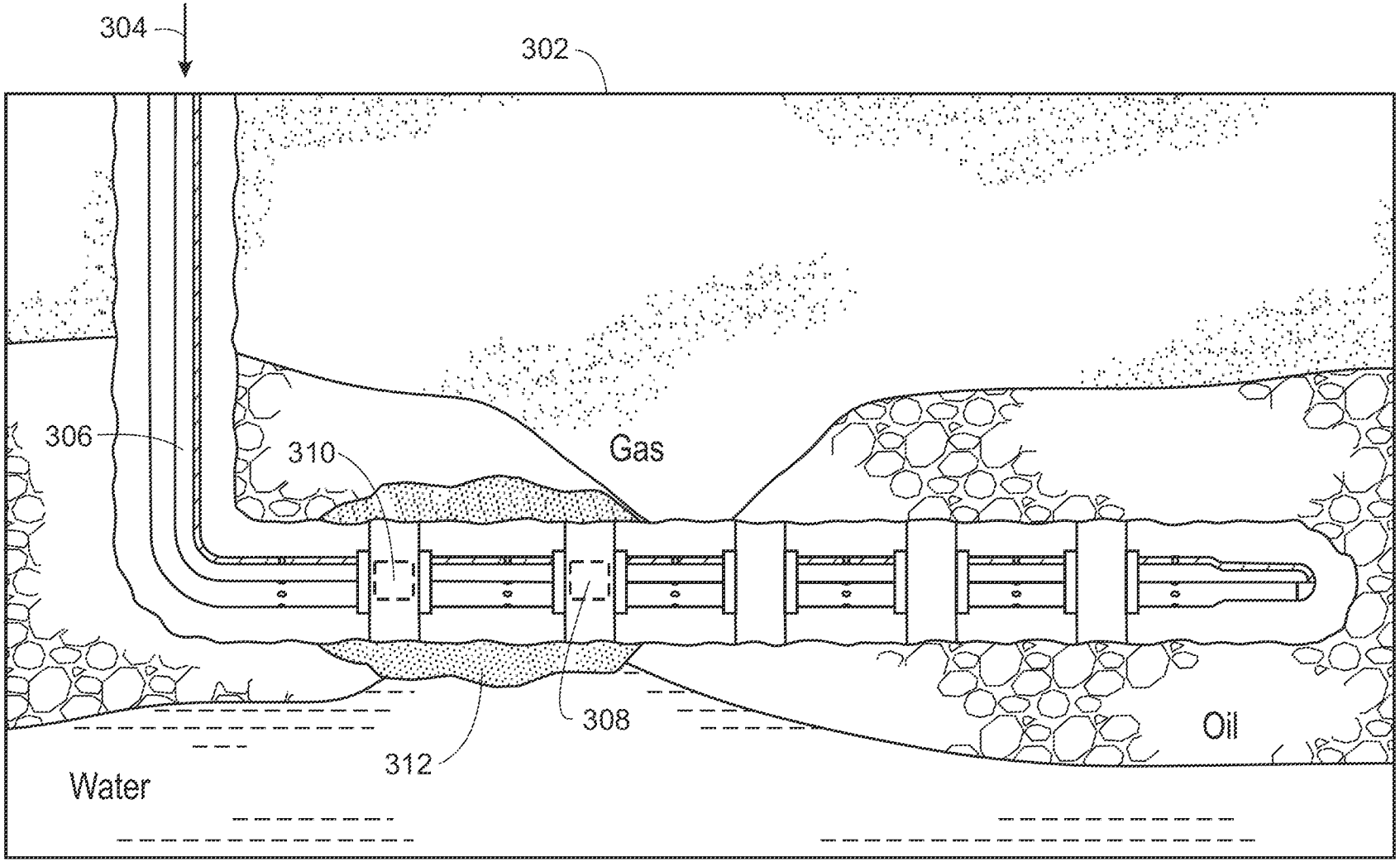
FIG. 3A is a diagram of a wellbore in a subterranean formation, which are the wellbore and subterranean formation of FIG. 2 but with a gellable treatment composition applied to isolate the water zone.

FIG. 3A is a wellbore 300 in a subterranean formation 302, which are the wellbore 200 and subterranean formation 202 of FIG. 2 but with a gellable treatment composition 304 (e.g., having NaSil, polymer, or resins) applied to isolate the water zone. The NaSil, polymer, or resin when mixed with fresh water or solvents and activator, can be squeezed as a slurry 304 (water-thin or having viscosity similar to water, or a greater viscosity) via coiled tubing 306 at the desired zone (water zone) after setting a (1) retrievable bridge plug (RBP) 308 and a (2) retrievable production packer (RPP) 310. Once the thermosetting chemical (e.g., NaSil, polymer, or resin) is exposed to the formation temperature (reservoir temperature), the thermosetting chemical will solidify creating a solid flow barrier 312. In other words, at the water zone, the gellable treatment composition 304 flows into the formation 302 and forms a gel to plug the porosity of the formation 302. The gellable treatment composition 304 is gelled via a chemical activator, such as an accelerator (e.g., salt), crosslinker, catalyst, acid, etc., in the composition 304 and by heat from the formation 302 increasing the temperature of the composition 304 to the formation 302 temperature.

Contrary to certain embodiments, this application with thermosetting chemicals including (or not including) NaSil may be implemented with the well (wellbore) shut-in for a specified time after the squeeze (e.g., after injection of the composition 304) until those compounds (composition) can solidify (form a gel). Unfortunately, during that time of the well shut-in, residual thermosetting chemicals (e.g., residual gellable treatment composition 304) in the wellbore 300 (at the zone being treated) including in the downhole tools, such as the coiled tubing 306, RBP 308, and RPP 310, can solidify (gel). This solidification (gelling) of residual gellable treatment composition 304 in the wellbore 300 may occur especially between the RBP 308 and the RPP 310. Such may transpire while waiting for the solid flow barrier 312 (gelled treatment composition 304) to form inside the subterranean formation 302 zone. In this situation of residual gellable treatment composition solidifying (gelling) in the wellbore 300, the well (wellbore 300) may be practically plugged and thus inoperable. Conversely, the application depicted in FIG. 3A generally does not require a well shut-in and avoids significant gelling inside the wellbore 300.

Figure 3B:
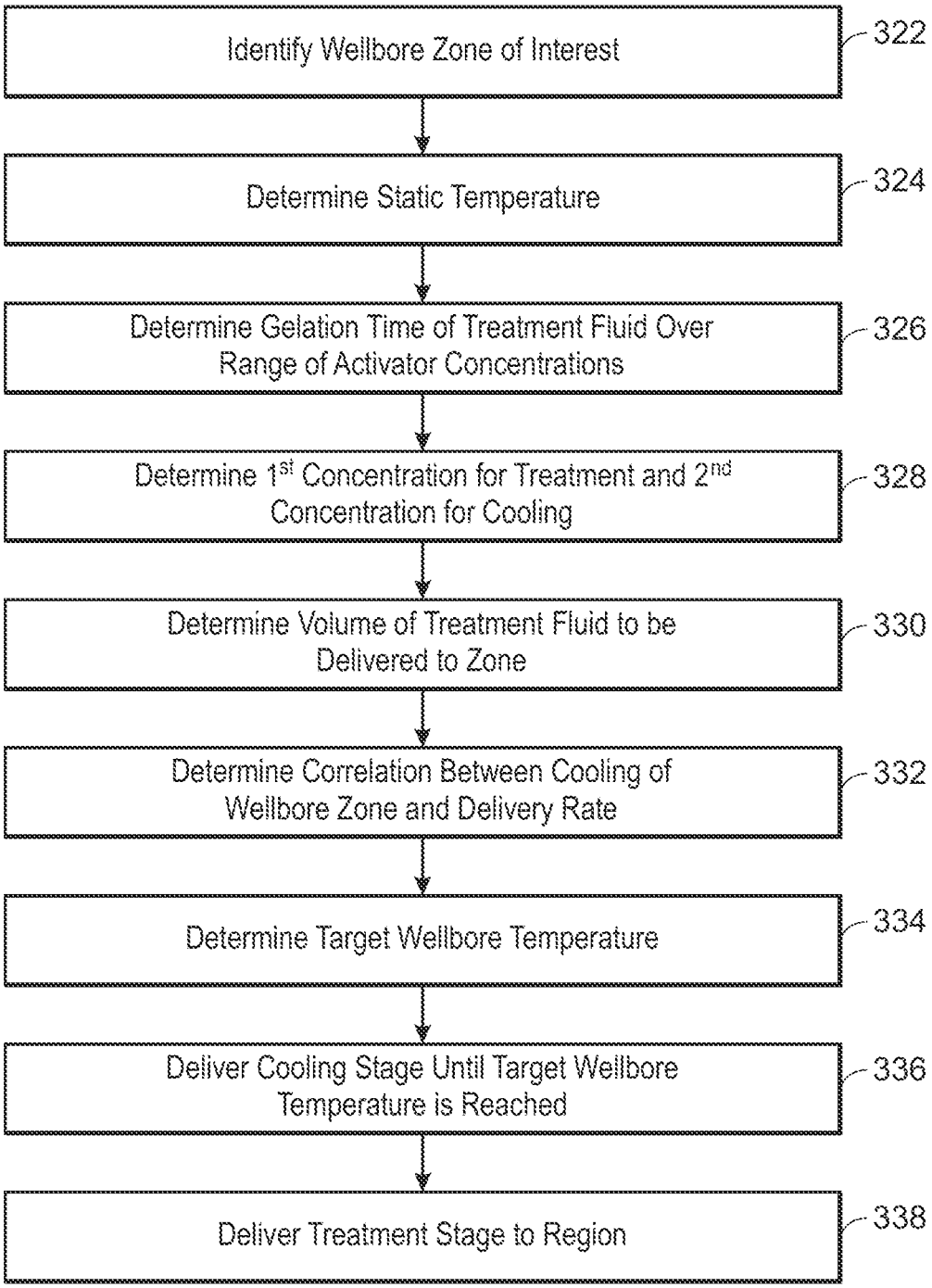
FIG. 3B is a block flow diagram of a method of treating a region of a subterranean formation adjacent a wellbore zone.

FIG. 3B is a method 320 of treating a region of a subterranean formation adjacent a wellbore zone. At block 322, a wellbore zone of interest (such as the zone 116 of in FIG. 1) is identified, for example, using a production log. At block 322, a static temperature of the region of the subterranean formation adjacent to and surrounding the wellbore zone of interest at the same or similar depth is determined, for example, using a temperature sensor. At block 326, a time duration for gelation of a treatment fluid (such as the gellable treatment composition 120) is determined over a range of concentrations of an activator (e.g., accelerator or crosslinker). The treatment fluid may be the aforementioned embodiments of the gellable treatment composition 120. Time durations for gelation of the treatment fluid over the range of activator concentrations are determined at various temperatures at block 326. The various temperatures include the static temperature of the region of the subterranean formation to be treated determined at block 324. For example, time durations for gelation of the treatment fluid over the range of activator concentrations are determined at a first temperature, and time durations for gelation of the treatment fluid over the range of activator concentrations are determined at a second temperature, and so on for each selected temperature.

At block 328, a first concentration of the activator is determined for a treatment stage, and a second concentration of the activator is determined for a cooling stage based on the time durations for gelation of the treatment fluid determined at block 326. At block 330, a treatment volume of the treatment stage to be delivered to the region of the subterranean formation adjacent the wellbore zone of interest is determined.

At block 332, a correlation between cooling of the wellbore zone of interest and a delivery rate of the treatment fluid to be delivered to the region of the subterranean formation adjacent to the wellbore zone of interest is determined. Delivering the treatment fluid and/or fresh water to the region of the subterranean formation via the wellbore can alter the temperature of the wellbore. For example, delivering the treatment fluid and/or fresh water to the subterranean formation via the wellbore can cause the wellbore to cool.

At block 334, a target wellbore temperature for the wellbore is determined. The target wellbore temperature determined at block 334 is less than the static temperature of the region of the subterranean formation to be treated (the region of the subterranean formation adjacent the wellbore zone of interest) determined at block 324. In implementations, a difference between the target wellbore temperature and the static temperature of the region is a 68° F. differential (38° C. differential) or less, 55° F. differential (31° C. differential) or less, 50° F. differential (28° C. differential) or less, 40° F. differential (22° C. differential) or less, 35° F. differential (19° C. differential) or less, or 30° F. differential (17° C. differential) or less. In implementations, this temperature differential is at least 35° F. (19° C.), at least 40° F. (22° C.), or at least a 50° F. (28° C.). In implementations, the temperature difference between the target wellbore temperature and the static temperature of the region of the subterranean formation to be treated is in the ranges of 20° F. (11° C.) to 68° F. (38° C.), 30° F. (17° C.) to 55° F. (31° C.), or 35° F. (22° C.) to 50° F. (28° C.).

At block 336, the cooling stage is delivered to the subterranean formation via the wellbore until the wellbore zone of interest near or at the region of the formation to be treated the reaches the target wellbore temperature (determined at block 334). The cooling stage may be delivered at a delivery rate (pumping rate, injection rate), for example, in a range of from 0.5 bpm to 4 bpm at block 336. The cooling stage can include fresh water or can be similar to the treatment fluid. The cooling stage can include the thermosetting chemical and the second concentration of the activator. The second concentration of the activator in the cooling stage is different from the first concentration of the activator in the treatment stage. In implementations, the second concentration is less than the first concentration. Each of the first concentration and the second concentration may be, for example, in a range of 1 vol % activator to 40 vol % activator. In implementations, the second concentration is in a range of 10 vol % activator to 20 vol % activator.

At block 338, after delivering the cooling stage at block 336, the treatment volume (determined at block 330) of the treatment stage is delivered to region of the subterranean formation to be treated near the wellbore zone of interest via the wellbore. Delivering the treatment stage at block 338 results in forming a gel that is impermeable to fluid flow within the region of the subterranean formation. The gel that is formed is impermeable to fluid flow and can therefore shut off water and/or gas breakthrough. The treatment stage can be the same as or similar to the treatment fluid. The treatment stage includes the thermosetting chemical and the first concentration of the activator. In implementations, the first concentration is in a range of from about 1 vol % to about 40 vol %. The delivery rate at which the treatment stage is delivered can be at the maximum allowable pumping rate (or at least 80% of the maximum allowable pumping) that can be handled by the downhole equipment and surface pumps without running the risk of damaging the wellbore and/or fracturing the subterranean formation.

The delivery rate (pumping rate, injection rate) is, for example, in a range of from 0.3 bpm to 4 bpm at block 338. For embodiments of the treatment fluid (e.g., gellable treatment composition 120) directed to colloidal silica, the pumping rate may be, for example, in the range of 1.5 bpm to 4.0 bpm. For embodiments of the treatment fluid (e.g., gellable treatment composition 120) directed to polymer to form a polymer gel, the pumping rate may be, for example, in the range of 0.8 bpm to 2.5 bpm. For embodiments of the treatment fluid (e.g., gellable treatment composition 120) directed to resins, the pumping rate may be, for example, in the range of 0.3 bpm to 2 bpm.

The delivery rate at block 338 may be adjusted throughout implementation of block 338, such that a temperature of the wellbore zone is maintained at the target wellbore temperature (determined at block 334). In implementations, the delivery rate at block 338 is adjusted throughout implementation of block 338, such that a temperature of the wellbore zone of interest is maintained to maintain the specified temperature differential between target wellbore temperature (determined at block 334) and the temperature of the static temperature of the region of the subterranean formation. In certain implementations, the wellbore is not shut in throughout implementation of method 320.

In implementations, a flush stage is delivered to the subterranean formation via the wellbore after delivering the treatment stage at block 338. The flush stage can include water (e.g., fresh water). In some implementations, the flush stage is delivered at a delivery rate of about 0.5 bpm or less. In implementations, a hydrocarbon is produced from the subterranean formation after delivering the flush stage, once the gel has been formed within the treated region of the subterranean formation adjacent to the wellbore zone of interest.

In implementations, the cooling stage and the treatment stage are delivered (blocks 336 and 338, respectively) utilizing a coiled tubing installed in the wellbore 102. In implementations, after delivering the treatment stage at block 338, the coiled tubing is removed from the wellbore (also referred to as rigging down the coiled tubing), and then hydrocarbons can be produced from the subterranean formation, in some cases, immediately after or soon after the coiled tubing (and downhole devices) has been removed.

Figure 4A:
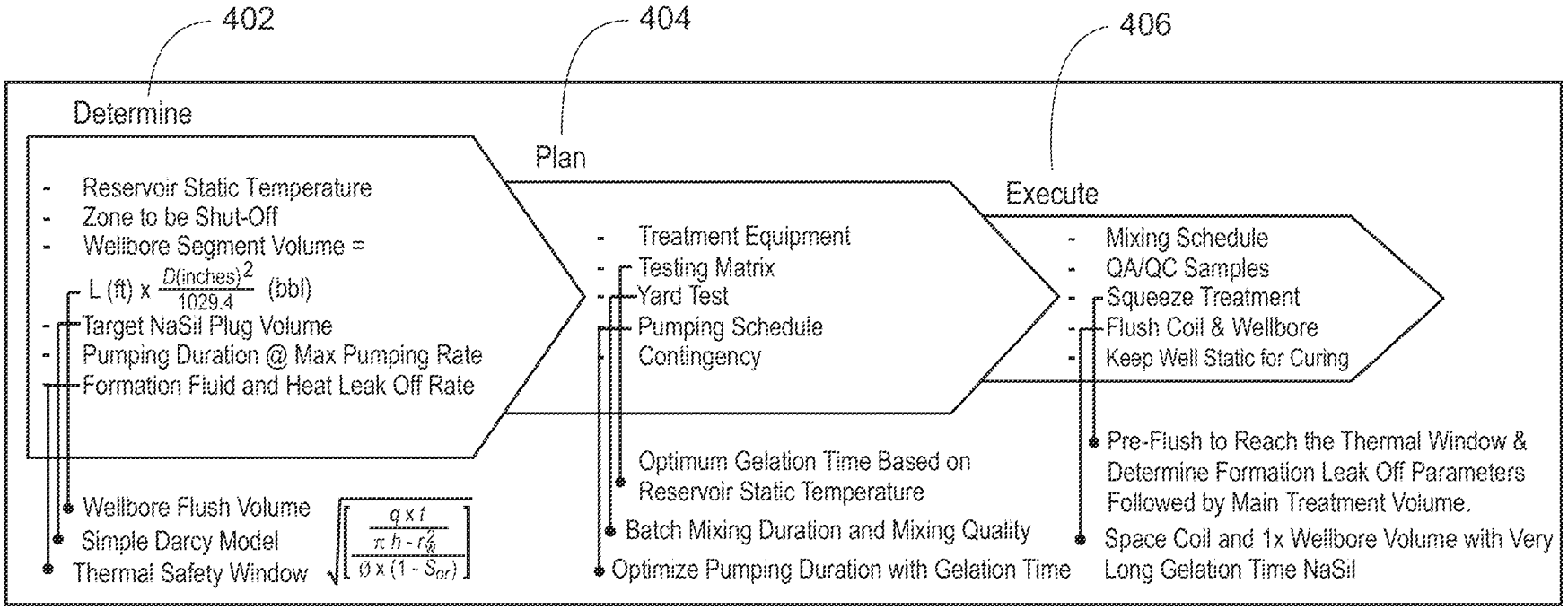
FIGS. 4A and 4B are diagrams of a workflow (method) of shutoff of a zone, such as a water zone or gas zone, with a gellable treatment composition while avoiding significant solidifying (gelling) of the gellable treatment composition in the wellbore. The workflows includes design technique.

FIG. 4A is a workflow 400 (method, procedures) of shutoff of a zone, such as a water zone or gas zone, with a gellable treatment composition (e.g., having thermosetting chemicals, such as NaSil, polymers, or resins) while avoiding significant solidifying (gelling) of the gellable treatment composition in the wellbore. The workflow 400 (method) includes design technique. In implementations, the downhole equipment can be retrieved substantially immediately after squeeze operations. The squeeze operations include application of the gellable treatment composition (e.g., thermosetting chemical composition), such as injection of the composition into the subterranean formation at the zone being treated. A plug is formed in the subterranean formation contemporaneously with completion of the squeeze of the gellable treatment composition. In other words, the gellable treatment composition as gelled is formed in the subterranean formation (as desired giving the treated zone isolated) substantially simultaneously with completion of the injection of the gellable treatment composition. In implementations, the well can be flowed and produced immediately or substantially immediately (e.g., less than 10 minutes) after treatment and without implementation of a well shut-in. For embodiments, there is no wellbore shut-in time for shutoff of a zone with the gellable treatment composition. After the treatment and after removal of the coiled tubing downhole devices (tools) utilized for the treatment, the wellbore may be substantially clear (e.g., little or no solid residuals). In embodiments, no cleaning operations or milling of any solid residuals is performed.

In the Example 5 below, this workflow 400 (procedure) was generally implemented in the field utilizing a gellable treatment composition having NaSil. The treatment composition was thermally activated (into a gel) via formation temperature and a chemical activator. The procedure including specifying and implementing pumping schedule (pumping rate, stage volumes, and total pumping duration), activator concentration, and control of the wellbore temperature.

The workflow 400 may be implemented for the differing embodiments of the gellable treatment composition (treatment fluid) having the various aforementioned thermosetting chemicals. The workflow 400 includes a determining phase 402, a planning phase 404, and an execution phase 406. The phases may overlap. Some respective aspects of the phases 402, 404, and 406 may be implemented in parallel or contemporaneously. In other words, a rigid sequential implementation of the phases 402, 404, and 406 in order may not be required.

The determining phase 402 may include measuring the reservoir (formation) static temperature, identifying the wellbore zone to be shutoff, and calculating the wellbore segment volume of the wellbore zone to be shutoff. The wellbore segment volume may be the volume of the pipe (production tubing) in the zone to be shutoff. An example equation is depicted that calculates the volume in barrels (bbl) as a function the pipe length in feet (ft) and pipe diameter in inches. This calculated volume may give the wellbore flush volume. The wellbore flush volume may be the flush volume of treated zone (treated segment) and not the flush volume of the entire wellbore.

The determining phase 402 may estimate or calculate the plug volume of the target gel (e.g., NaSil gel or polymer gel) in the subterranean formation. Fluid-flow relationships or equations, such as a Darcy model, may be utilized. For instance, the equation depicted for the Darcy model may be adopted for at least horizontal wells in porous media. The variables in the depicted Darcy equation are: r (gelant radius) in feet (ft), q (injection rate) in barrels per day (bbl/day), h (formation height) in ft, $r_w$ (wellbore radius) in ft, $\phi$ (formation porosity), $S_{or}$ (residual oil saturation), and t (gelation time) in days.

The determining phase 402 may determine the pumping duration of the gellable treatment composition at the maximum or high end (e.g., top 10%) of the pumping rate of the surface pump, and evaluate formation fluid leak off rate and formation heat leak off rate to account for a thermal window. As for the formation fluid and heat leak off rate, because the treatment volume is generally limited, the formation at the treated zone may generally remain hot (e.g., at or near the normal formation temperature at that depth), and the heat may leak off to the cooler wellbore once the wellbore is cooled during the pre-flush stage. This can be estimated, for example, during the step rate pre-flush stage of the workflow. The thermal window may be the temperature difference (e.g., maximum temperature difference) that could be achieved between the wellbore (treated segment) and that of the formation during the treatment. This creates an operating window to avoid gelling inside the wellbore while pumping the treatment into the formation. This operating window may be refer to as a safe operating window with respect to low risk gelling in the wellbore.

The planning phase 404 may include identifying and obtaining treatment equipment, implementing a testing matrix to determine beneficial or optimum gelation time based on reservoir static temperature, and completing yard test(s) of the gellable treatment composition to evaluate batch mixing duration and mixing quality. The batch mixing may refer to the preparation of the gellable treatment composition. In particular, the batch mixing may refer to the mixing of the component (e.g., NaSil or polymer) to be gelled, the solvent (e.g., water), and the activator (e.g., salt or crosslinker) to give the gellable treatment composition. The batch mixing may be performed, for example, in a vessel at the well site. The batch mixing may be performed in a vessel away from the well site, and the composition as mixed transported to the well site.

The planning phase 404 may specify pumping schedule to give beneficial pumping duration considering gelation time. The pumping schedule may optimize pumping duration with gelation time. In considering the volume to be pumped, the pumping duration can be estimated based on the pumping rate. Therefore, gelation time can be adjusted by varying the concentration of the activator. The objective may be to bridge the gel inside the formation and avoid gelation inside the wellbore. A reasonable "gelation-time" should be sufficient to allow pumping of the gellable treatment composition through the coiled tubing into the target zone. It is desired that there is no significant gelling in the coiled tubing.

The execution phase 406 may include applying a mixing schedule, performing quality assurance (QA)/quality control (QC) testing of samples of the gellable treatment composition as mixed, and implementing the squeeze treatment of the gellable treatment composition. The mixing schedule may include, for example, the number of pumping stages, slurry volume for each stage, the pumping rate and duration, and so forth. For the QA/QC testing, samples of the gellable treatment composition (e.g., polymer and crosslinker, or resin and activator, or NaSil and activator in water, etc.) from the batch mixer may be collected prior to pumping of the gellable treatment composition into the wellbore. These field samples may be tested to measure properties, such as slurry consistency (or percent solids), density, and viscosity. The gelation time of the field samples at specified temperatures may be determined and the results compared to the gelation time as determined in initial testing of laboratory-prepared compositions.

In the execution phase 406, a pre-flush may occur as an initial portion or stage of the squeeze treatment (or prior to the squeeze treatment) to reach the thermal window and determine formation leak off parameters. The pre-flush may be via pumping of fresh water and/or the gellable treatment composition as "diluted" (e.g., low concentrations of the thermosetting chemical and activator) into the wellbore. The desired thermal window (wellbore temperature versus formation temperature) reached may mean that the wellbore temperature is cooled enough (e.g., at least 50° F. less that formation temperature) such that no significant gelling of the gellable treatment composition occurs in the wellbore. The pre-flush may flow into the formation at the zone to be treated.

The main treatment volume (e.g., the majority of the gellable composition injected) of the squeeze may follow the pre-flush. In implementations, the main treatment volume may be "concentrated," such as in having high concentrations of thermosetting chemical and activator. While the intent of the squeeze of the main treatment volume is to inject the gellable treatment composition into the formation to plug the formation at the zone of interest (the zone being treatment) (the region of the formation being treated), the flow of the main treatment volume may cool the wellbore zone. The main treatment volume may keep the wellbore zone cooler than formation temperature, and with the main treatment volume not experiencing temperature increase adequate for gelling in the short time the main treatment volume is in the wellbore. The main treatment volume may experience significant temperature increase once in the formation and thus gel relatively quickly in the subterranean formation.

After the squeeze, the execution phase 406 may include flushing the coiled tubing and the wellbore. In certain implementations, the gel (bulk of the gel) in the formation may be already cured by the time the squeeze pumping has ended. The flush may involve flushing with a gellable treatment composition having a low concentration of activator (such that the gellable treatment composition has a long gelation time) and with a volume of gellable composition equal to at least the volume of the coiled tubing. In implementations, any residual gellable composition in the wellbore may have a gelation time approaching infinite due to the lower temperature of the wellbore as compared to the formation. To flush the coil (space coil and 1× wellbore volume with thermosetting chemical composition having relatively long gelation time) may mean that the coil and treatment equipment are washed clean (prior to pull out to surface) of gellable material that might cause damage to the equipment or wellbore. Moreover, the flush may be with water or brine and not with the gellable treatment composition having a long gelation time. The flush volume may be equal to the coil tubing volume plus the treated wellbore segment volume. This flush may wash the coiled tubing and downhole treatment tools in the wellbore prior to pulling the coiled tugging and downhole treatment tools out of hole to the Earth surface. For instances with brine as the flush fluid, eventually brine may not contact the formation but mix with remnant gellable composition in the wellbore making the remnant gellable composition weaker (more dilute) and longer to set (practically, a very long time in days beyond the treatment duration in hours). The well may be maintained static during pulling out of hole the treatment equipment.

A procedure for shutoff of a wellbore zone of interest utilizing a gellable treatment composition that is thermally activated via formation temperature and a chemical activator may include the following. Based on formation temperature, length of zone to be plugged, and the depth to penetrate into the subterranean formation around the wellbore, the main treatment volume the gellable treatment composition (e.g., thermosetting chemical composition) is calculated. Such may be calculated or determined based on, for example, an experimental gelation matrix. The experimental gelation matrix may be utilized to determine: (1) main treatment stage volume (e.g., the maximum allowable volume of a main treatment stage); (2) number of main treatment stages; and (3) pumping duration (e.g., low or minimum pumping duration). For instance, FIG. 7A (experimental gelation matrix in Example 1) may be so utilized for an NaSil embodiment.

In typical cases, the treatment having three stages (pre-flush, main treatment, and post flush) is adequate. However, in some cases of deep-penetrating treatments in the formation or large formation volume treated, practically performing the main treatment in a single stage may not be feasible while avoiding premature gelling inside the wellbore. Thus, multiple stages of the main treatment may be implemented. In such cases, the highly permeable features of the formation may be, for example, a super-k zone capable of producing at least 500 barrels per day per foot of thickness. Other features that are highly permeable, deep, or large volume in the formation may be applicable for cases in which multiple stages of the main treatment are performed.

Deployment objectives or actions may include to initially cool down the wellbore (e.g., as quickly as possible) with a small volume of NaSil slurry of low activator concentration pumped into the wellbore. Then, once target wellbore temperature [e.g., at least 50° F. (27.8° C.) less than the formation (reservoir) temperature] is reached, start squeezing the main treatment that is NaSil slurry of high activator concentration (e.g., at least 25 wt %) at a high (e.g., at least 80% of pump capacity) or highest pumping rate of the surface pump. If the stage volume is reached, a spacing NaSil composition stage may be implemented with low activator concentration and pumped at a high or highest pump rate. The stage volume may be case specific. For instance, when treatment is intended to impair or plug fractures and/or super permeable zones, the treatment volume can be relatively large depending on the subterranean formation character. After the main treatment is pumped, a spacing stage of thermosetting chemical composition with relatively low activator concentration may be squeezed at a low or lowest pump rate (e.g., less than 20% of pump capacity) such as for at least twice the gelation time of the main treatment. The spacing stage may be a relatively low activator concentration (e.g., less than 10 wt %) to facilitate maintaining the contrast between the wellbore temperature and the formation temperature. For instance, in NaSil embodiments, the spacing stage may be a NaSil with low activator concentration (e.g., less than 10 wt %). A spacing stage including this final spacing stage may be meant to maintain the wellbore cool while allowing the gel to form inside the formation without forming inside the wellbore. Lastly, if desired or beneficial, the coiled tubing can be flushed with fresh water (e.g., treated fresh water) before pulling the treatment equipment (e.g., coiled tubing, retrievable packer, retrievable bridge plug, etc.) out of well, and the well (wellbore) opened back to production flow from the subterranean formation.

Figure 4B:
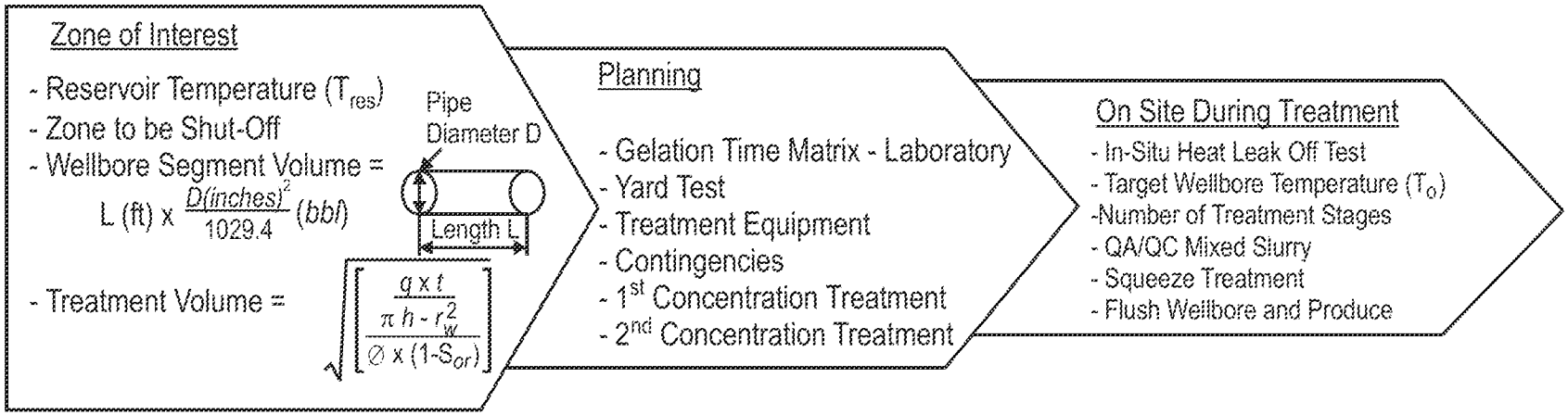

FIG. 4B is a workflow (method, procedures) of shutoff of a zone, such as a water zone or gas zone, with a gellable treatment composition (e.g., having thermosetting chemicals, such as NaSil, polymers, or resins) while avoiding significant solidifying (gelling) of the gellable treatment composition in the wellbore. The workflow may give similar advantages as with the workflow 400 of FIG. 4A. The workflow depicted in FIG. 4B includes identification and evaluation of the zone of interest, a planning stage, and a direct stage of on-site treatment.

The reservoir (formation) temperature (Tres) and target zone may be determined by logging such as production logs. The target zone may include the target region or zone of the subterranean formation adjacent to the wellbore at the wellbore zone of interest. The wellbore segment volume ($V_b$) may be determined based on the knowledge of well and completion data such openhole diameter, wellbore (pipe) diameter, and length of the interval in order to estimate the volume of residual or flush volume to fill that space during the operation. If the length of the zone of interest (L) is 500 ft, with a bore internal diameter (Di) is 3.995 inches, then $V_b \approx 8$ BBL.

The treatment volume (V) may be determined based on the aforementioned Darcy equation based on depth of penetration inside the zone to be treated. Knowledge of basic reservoir such as porosity, formation thickness, etc. is generally utilized. The treatment volume may vary depending on the nature and purpose of the shut-off application. In order to isolate the annulus of small completion interval, the depth of penetration is few inches and therefore the volume treatment volume applied may be less than a few barrels, such as less than ten barrels. In applications where isolation of a fracture corridor or a thief zone is intended, then the depth of penetration could be few feet and the volume of treatment could be in the order of few hundred barrels, such as a range of 250 barrels to 750 barrels. Factors to determine the treatment volume (including with respect to the Darcy equation) may include radius of treatment penetration, presence of fractures, radial permeability profile around the wellbore, and gravity effects in horizontal wells.

Figure 4C:
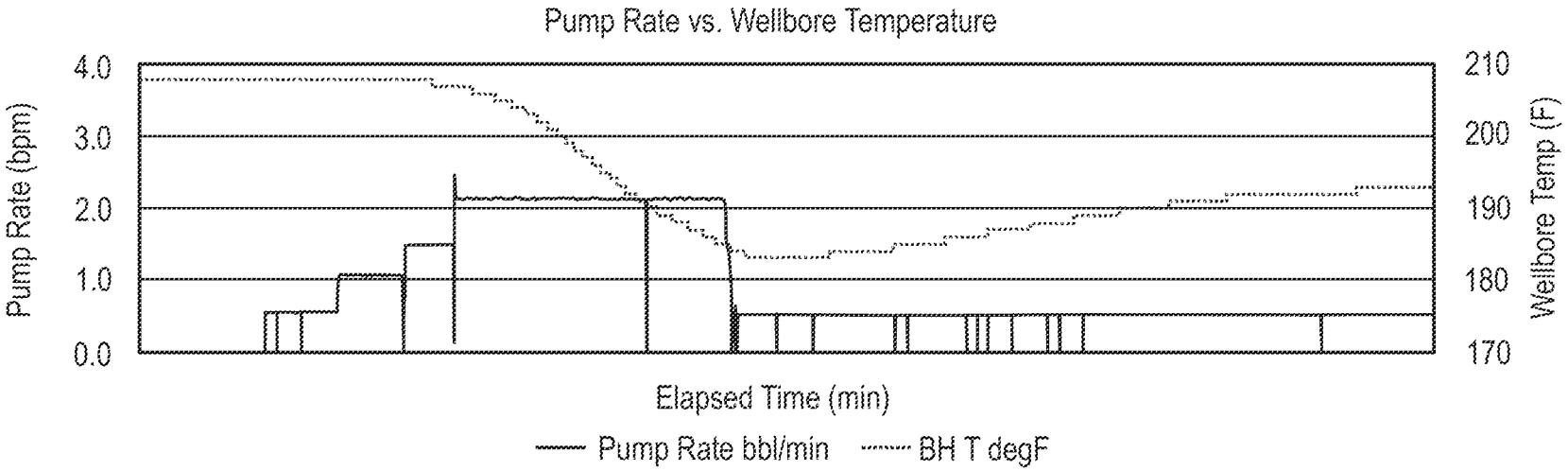
FIG. 4C is a plot showing wellbore temperature in relation to fresh water delivery rate to the wellbore.

The target wellbore temperature ($T_o$) is initially $T_o = T_{res}$ during routine and steady production operation of the well prior to treatment. During the treatment, $T_o$ will drop because the treatment fluid temperature ($T_f$) is cooler than the wellbore. The treatment fluid pumped volume during the operation generally does not alter the reservoir temperature. The reservoir could be regarded as an infinite adiabatic system. The wellbore within the treated interval has a relatively small volume and is therefore the wellbore temperature is altered the cooler fluid during the pumping operation. Heat transfer will occur between the wellbore with cool injected fluid and with the hotter reservoir. A beneficial or optimum $T_o$ is reached when the wellbore will substantially immediately or relatively quickly heat up to $T_{res}$ once again when pumping is reduced or stopped. This heat exchange correlation is determined in situ as a function of pumping rate of fresh water or of a treatment fluid having relatively long gelation time before initiating the treatment. Fresh water may be beneficial because fresh water can be mixed with conditioning chemicals known as mutual solvents that can condition the treated zone prior the treatment as well. For planning purposes, a target $T_o$ may be estimated, for example, in the range of 35° F. (19° C.) to 68° F. (38° C.) less than $T_{res}$. FIG. 4C presents such correlation from actual field data while executing the job.

FIG. 4C is a plot showing wellbore temperature in relation to fresh water delivery rate to the wellbore. The plot indicates the effect of pumping rate on wellbore temperature. As shown in the plot, larger pumping rates result in decreases in wellbore temperature. It is assumed that the fresh water being delivered to the wellbore is cooler than the fluids already disposed within the wellbore (for example, wellbore fluids). Understanding the relationship between delivery rate and wellbore cooling allows for the wellbore temperature to be maintained at a target temperature that is less than the temperature of the zone of interest throughout implementation of the selective zonal isolation treatment operation, such that the gel impermeable to fluid flow forms in the subterranean formation zone of interest and not in the wellbore. For example, for a target wellbore temperature of 50° F. less than the static temperature of the subterranean formation, a treatment volume can have a gelation time significantly longer that at the static temperature of the subterranean formation.

Figure 7A:
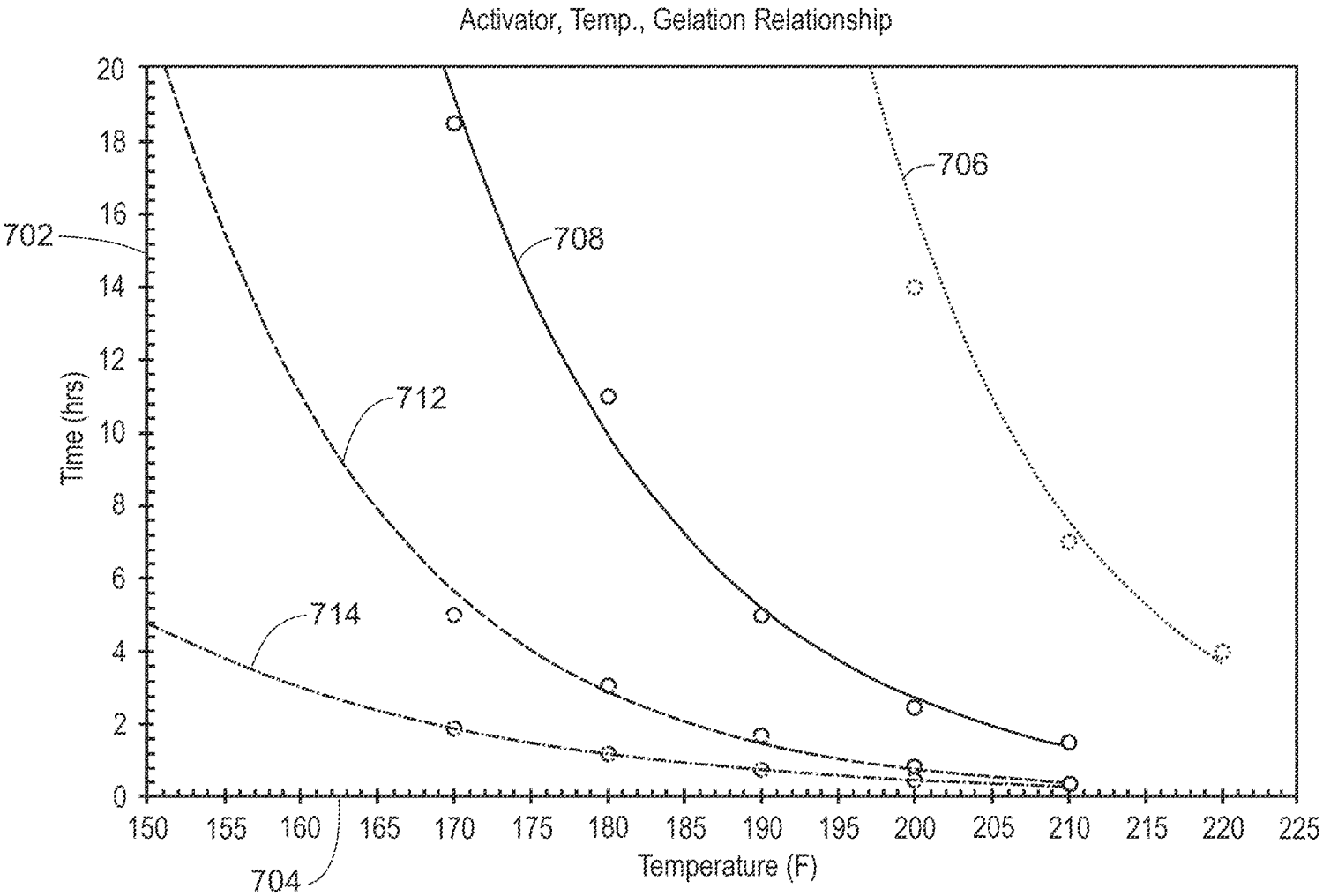
FIGS. 7A, 7B, and 7C are each a plot indicating gelation time of a gellable treatment composition as a function of the temperature and activator concentration of the gellable treatment composition.
Figure 7B:
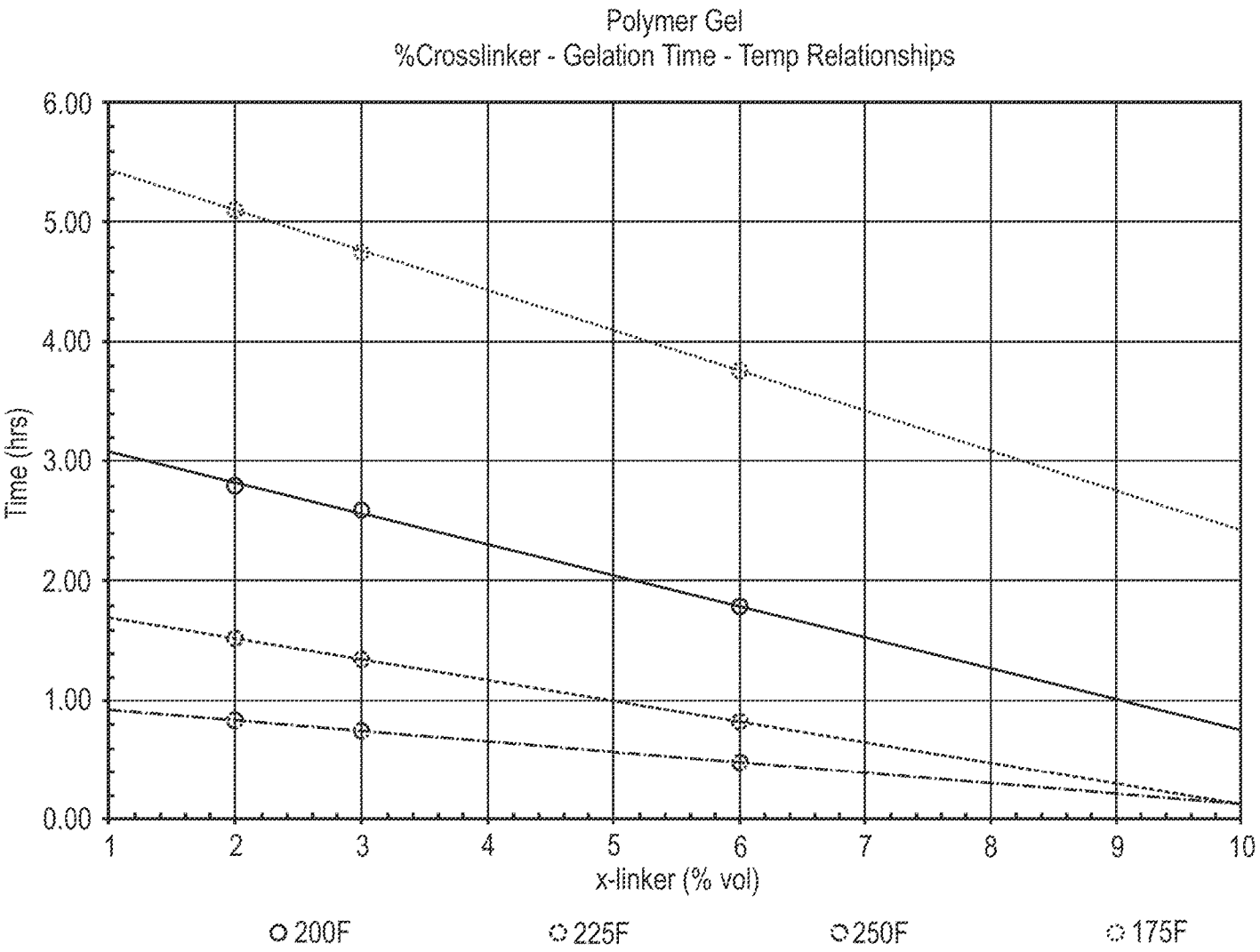
Figure 7C:
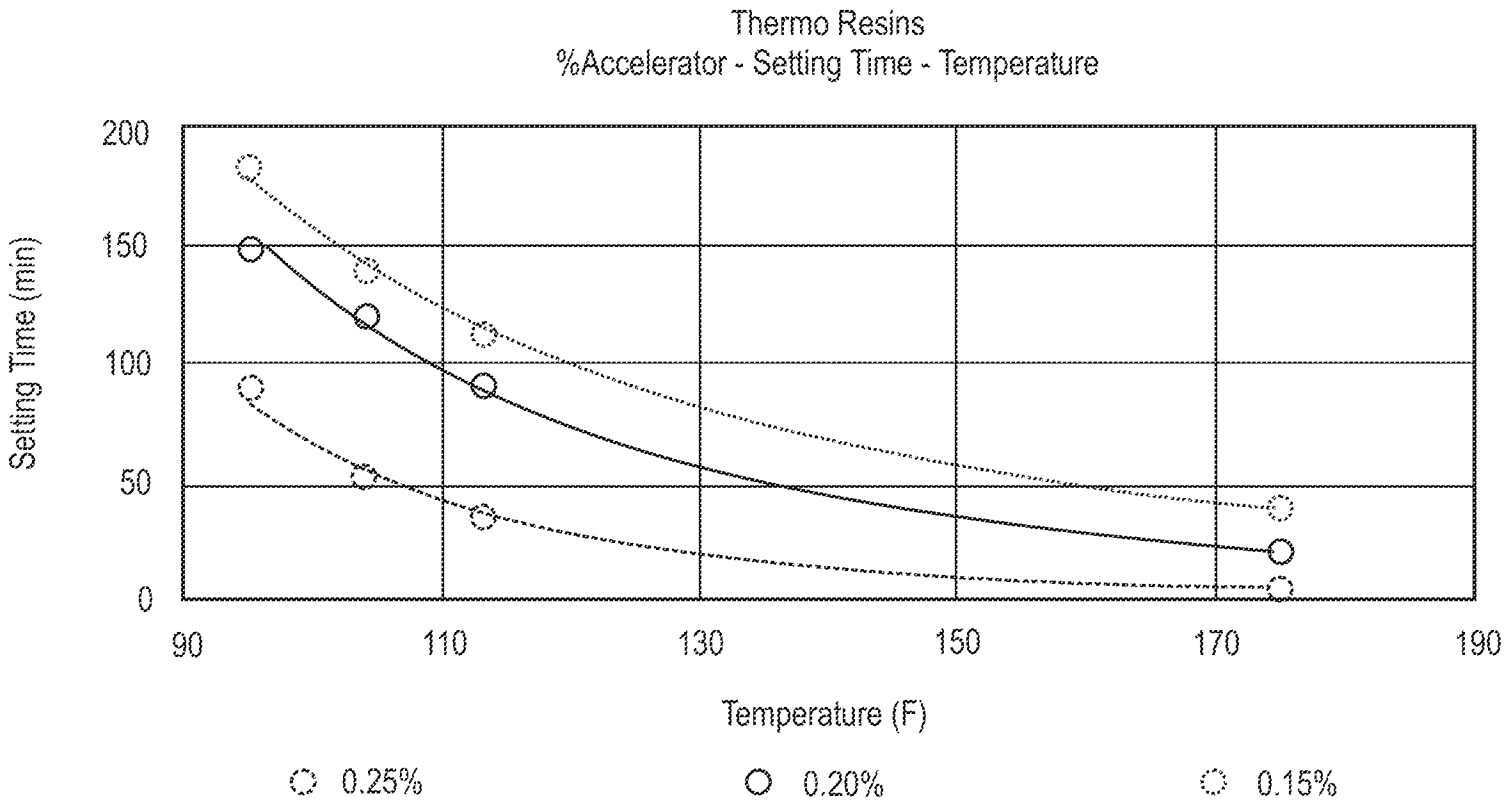

Returning to FIG. 4B, the workflow may generate a gelation time matrix. A feature of thermosetting (thermo-gelling) chemicals is their gelation, bridging, solidification time may be controlled by varying activator concentration, exposure time in the treatment, and the amount and type of retarding agents. Again, the chemical activator may include an accelerator, catalyst, crosslinking materials, and so forth. An practice may be to determine a beneficial concentration for the activator that fits $T_{res}$ and adjust the gelation process (gelling, crosslinking, polymerization, etc.) by adding retarding agents to give adequate pumping time and clean retrieval of downhole treatment equipment. FIGS. 7A, 7B, and 7C indicate gelation time for thermosetting chemicals as a function of activator concentration. FIG. 7A is an example of a colloidal silica gelation matrix. FIG. 7B is an example of a polymer gels gelation matrix. FIG. 7C is an example of a resins (thermo-resins) gelation matrix.

In the workflow of FIG. 4B, the $1^{st}$ concentration ($C_1$) of activator is for the primary treatment volume that will allow quick gelling or bridging once the primary treatment volume is in contact with the native temperature [$T_{res}$] of the subterranean formation zone of interest. The primary treatment volume (having $C_1$ of activator)=V. The $2^{nd}$ concentration ($C_2$) of activator is for the secondary treatment volume characterized by dilated gelation or bridging time compared to the primary treatment volume with $C_1$. The strength of $C_2$ is less than $C_1$ and is implemented the secondary treatment volume is implemented if the total pumping time of the primary treatment volume is more than the gelation/bridging time of a treatment volume at $C_1$ at $T_o$. A purpose of secondary volume (at $C_2$) is to replace the wellbore of the primary treatment volume (at $C_1$) with an equivalent volume of the secondary treatment volume (at $C_2$). By doing so, the pumping time may been extended in practice without risk of gelling or bridging the primary treatment volume (having $C_1$) inside the wellbore.

The volume of the secondary treatment volume (having $C_2$) may be, for example, equal to 2 times $V_b$. Again, $V_b$ is the wellbore segment volume in which treatment fluid flows. The secondary treatment volume may be, for example, in the range of 1 times $V_b$ to 3 times $V_b$. The lower end (e.g., 1 times $V_b$) may be adequate for vertical wells. The middle (e.g., 2 times $V_b$) may be better for horizontal wells due to gravity effects because the objective may be to effectively replace the wellbore contents of $1^{st}$ concentration of activator with $2^{nd}$ concentration of activator. The higher end (e.g., 3 times $V_b$) may be applicable for viscous thermosetting chemicals. Again, however, a secondary treatment (at $C_2$) after the main treatment may not be needed in that many treatments may be achieved in one stage (primary treatment) without spacing applied.

The primary treatment can be multiple stages. The number of primary (main) treatment stages with composition at $C_1$ can be calculated as follows. The number of main treatment stage may be equal to:

Gelation Time of $1^{st}$ Conc. (min) @Wellbore Temp.+Treatment Volume (V, bbls)/Pumping Rate (bbl/min)

Figure 5A:
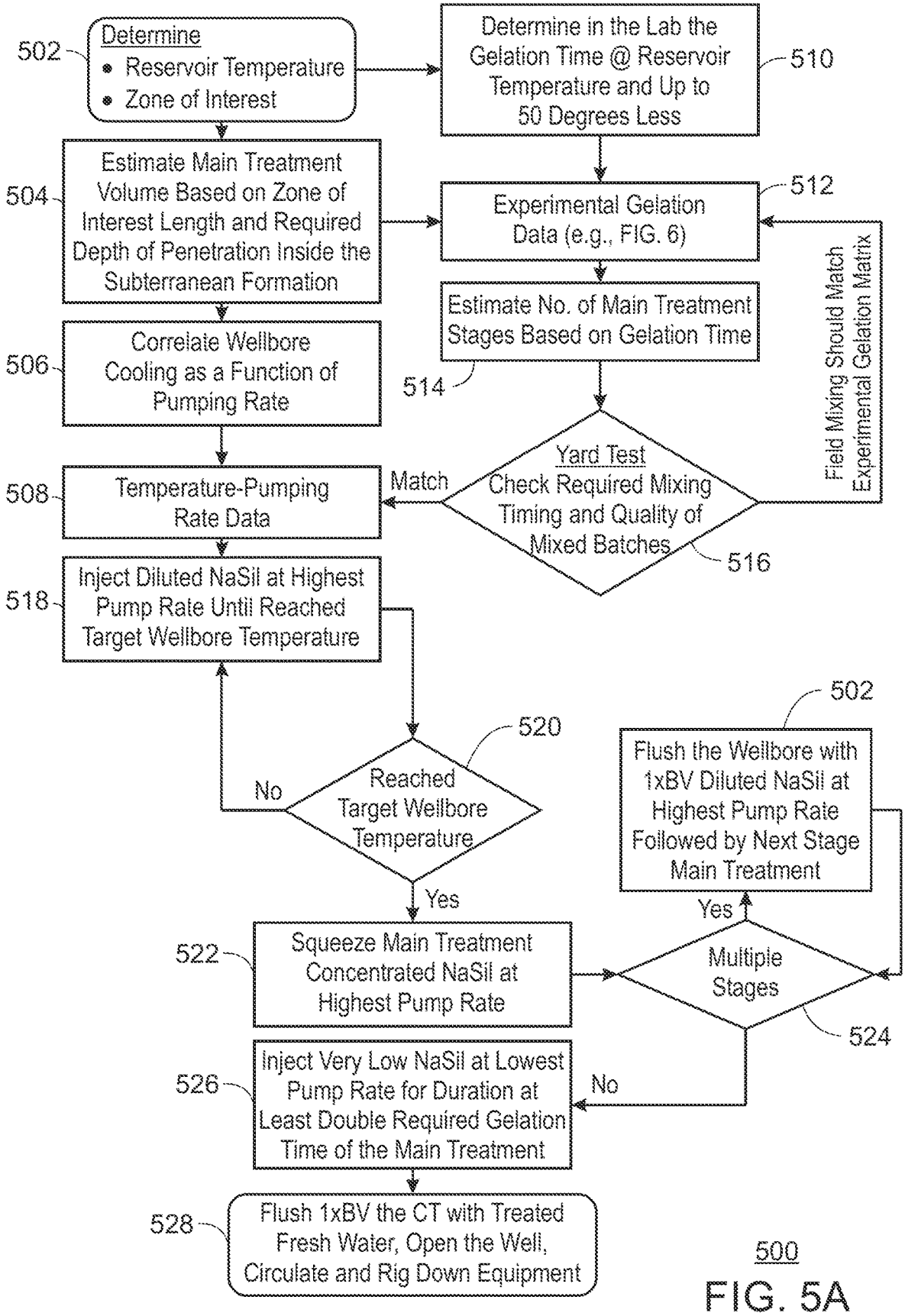
FIGS. 5A and 5B are a block flow diagram of a method (procedure, workflow) of shutoff of a wellbore zone of interest utilizing a gellable treatment composition that is thermally activated via formation temperature and a chemical activator. The methods include design workflow.
Figure 5B:
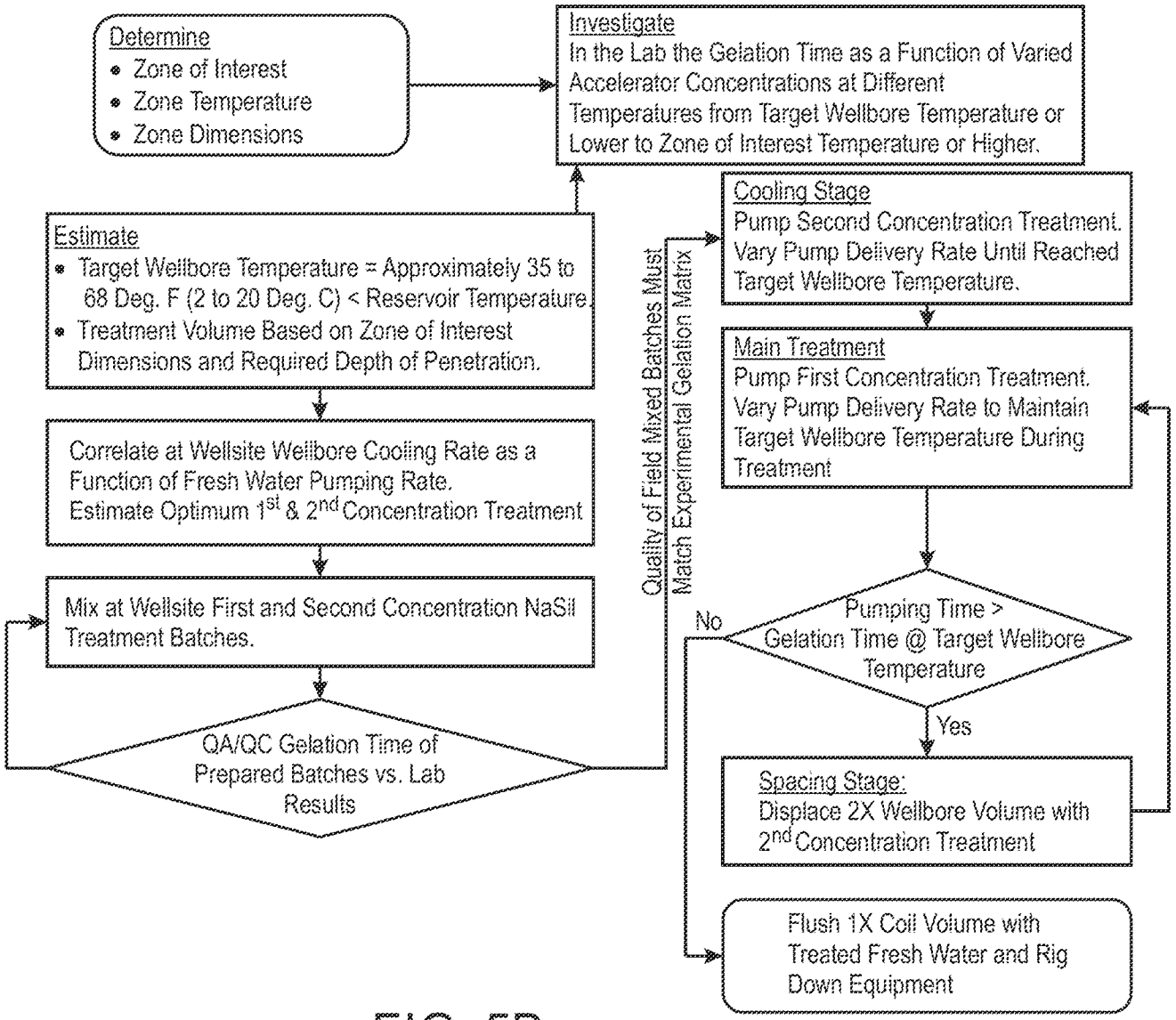

FIGS. 5A and 5B each give a general workflow of the treatment design.

FIG. 5A is a method 500 (procedure, workflow) of shutoff of a wellbore zone of interest utilizing a gellable treatment composition that is thermally activated via formation temperature and a chemical activator. FIG. 5A presents a general workflow of embodiments of the treatment design. At block 502, the method includes identifying a wellbore zone of interest to treat and measuring the subterranean formation (reservoir) temperature at the wellbore zone of interest. At block 504, the method includes estimating the main treatment volume of the gellable treatment composition based on the length of the zone of interest and on the depth of predicted penetration of the gellable treatment composition into the subterranean formation at the zone of interest. At block 506, the method may correlate wellbore cooling as a function of the pumping rate (surface pump) of the gellable treatment composition and in view of the main treatment volume (block 506). The method may rely on data 508 that correlates wellbore temperature (e.g., in ° F. or ° C.) versus pumping rate (e.g., in barrels per minute) of the gellable treatment composition.

At block 510, the method includes determining in the laboratory the gelation time of the gellable treatment composition at formation temperature at the zone of interest, and at temperatures at least 40° F. or at least 50° F. (27.8° C.) less than that formation temperature. The method may rely on experimental gelation data 512 (matrix, relationships), such as given in the plot (curves) of FIGS. 7A-7C. The experimental gelation data 512 (e.g., gelation matrix of NaSil treatment composition) may give the gelation time as a function of temperature at different concentrations of activator in the gellable treatment composition. At block 514, the method may estimate the number of main treatment stages based on the gelation time in view of the main treatment volume (block 504) and the experimental gelation data 512. At decision block 516, the method may perform yard tests of the gellable treatment composition to determine if the mixing timing and quality of the mixed batches match the experimental gelation data 510. The method may iterate through blocks 514 and 516 until a match (e.g., match of gelation time within 10%) is realized. A yard test may be a quality assurance step to upscale from lab scale (milliliters) to field treatment volumes (barrels). During this operation, determined is the time to unload and mix a batch (e.g., 50 barrels in volume) in the field, as well as the quality of mixed batch in the field. A good quality of the mixed batch may mean substantial agreement with the laboratory analysis of block 510 and the experimental gelation data 512.

At block 518, the method may inject (e.g., through coiled tubing) dilute gellable treatment composition into the wellbore at a high or highest pumping rate to cool the wellbore (the wellbore zone or segment at the formation region or portion to be treated) to a target wellbore temperature. The pumping rate may be, for example, at least 80% of the pump capacity for pumping the gellable composition into the wellbore. The dilute gellable treatment composition may be the gellable treatment composition dilute in the compound (e.g., NaSil) being gelled and low in activator concentration (e.g., less than 10 wt % activator). The gellable composition applied in block 518 is dilute compared to the gellable composition applied in block 522. The target wellbore temperature at the wellbore zone may be, for example, at least 50° F. (or at least 40° F. or at least 30° F.) less than the formation temperature at the zone of interest. The temperature difference between the lower target wellbore temperature at the wellbore zone versus the greater formation temperature at the zone of interest may be, for example, in the range of 50° F. (27.8° C.) to 70° F. (38.9° C.). Other applicable temperature difference ranges may include, for example, 40° F. to 70° F., 50° F. to 80° F., and 60° F. to 90° F.

The wellbore temperature may be measured. For example, the wellbore temperature may be measured via a coil-tubing telemetry system or by downhole tools utilized for the treatment, and the like. The temperature data as measured may transmitted in real time to the surface. Prior to injecting the dilute gellable treatment composition, brine or fresh water may be injected to clean the wellbore and estimate the wellbore response to cooling as a function of the pumping rate prior to injecting treatment slurry. In any case, the method may continue to inject the diluted gellable treatment composition until the target wellbore temperature is reached, as indicated at decision block 520.

At block 522, the method may squeeze (e.g., through coiled tubing) the main treatment of concentrated gellable treatment composition through the wellbore into the formation at the zone of interest. The concentrated gellable treatment composition may be gellable treatment composition concentrated in the compound (e.g., NaSil) being gelled and the activator. The decision block 524 may determine if multiple stages of the squeeze of the main treatment are to be implemented. If yes, then at block 526, the method may flush the wellbore with dilute gellable treatment composition at a high or highest pumping rate followed by the next stage of the main treatment (of concentrated gellable treatment composition). The method at the decision block 524 may determine if multiple stages (and how many stages) of the main treatment are to be implemented based on, for example, the volume of main treatment desired in the formation. If the method determines at the decision block 524 that multiple stages of the main treatment are not to be implemented or that an adequate number of stages of the main treatment have been implemented, the method proceeds to block 526.

At block 526, the method injects dilute gellable treatment composition at low or lowest pump for a specified time duration. The specified time duration may be, for example, at least twice the gelation time of the main treatment (concentrated gellable treatment composition) in the formation. Lastly, at block 528, the method flush $1\times V_b$ the coiled tubing with fresh water (e.g., treated fresh water), stop the pumping (surface pump), remove downhole treatment equipment, and place the well (wellbore) into hydrocarbon production from the subterranean formation through the wellbore (e.g., production tubing) to the Earth surface.

FIG. 5B is a method (procedure, workflow) of shutoff of a wellbore zone of interest utilizing a gellable treatment composition that is thermally activated via formation temperature and a chemical activator. FIG. 5B presents a general workflow of embodiments of the treatment design. The method includes determining the formation zone (region) of interest, the formation zone (region) temperature, and the wellbore zone and formation zone dimensions. In the laboratory, the gelation time as a function of varied activator (e.g., accelerator or crosslinker) concentrations at different temperatures from the target wellbore temperature (or lower) to the temperature of the subterranean formation zone (region) of interest to be treated (or higher). The target wellbore temperature may be specified in a range of 35° F. (19° C.) to 68° F. (38° C.) less than the formation (reservoir) zone temperature. The treatment volume (e.g., of the gellable treatment composition that may be a thermosetting chemical composition) may be specified based on the dimensions of the subterranean zone (region) of interest on and the depth of penetration into the subterranean zone for the treatment volume to adequately block the zone for shutoff.

The method may include correlating (at the well site) the wellbore cooling rate as a function of fresh water pumping rate. The method may involve estimating optimum or beneficial first and second concentrations of activator in the treatment fluid, as previously discussed. The second concentration is less than the first concentration. The gelation time is longer at the second concentration than at the first concentration.

Treatment fluid batches at the first and second concentrations of activator may be mixed (prepared) at the well site. The QA/QC gelation time of the prepared batches may be compared to the laboratory-generated results of experimental gelation time matrixes. The prepared batches may be adjusted or altered in response to the comparison. In response to the quality of the field mixed batches reasonably matching the experimental gelation matrix, the method may proceed to the cooling stage. In the cooling stage, the treatment fluid (e.g., gellable treatment composition) having the specified second concentration of activator may be pumped into the wellbore. The pump delivery rate may be varied until the target wellbore temperature is reached.

For the main treatment, the treatment fluid having the specified first concentration of activator is pumped through the wellbore into the subterranean formation zone being treated. Beneficially, the wellbore being cooled (in the cooling state) may facilitate preventing significant gelling of the treatment fluid in the wellbore during the main treatment. The pump delivery rate of the main treatment may be varied to maintain the target wellbore temperature during the treatment. If the pumping time of the main treatment is greater than the gelation time of the treatment fluid of the main treatment at the target wellbore temperature, a spacing stage may implemented after the main treatment. The spacing stage may displace, for example, two times the wellbore volume with the treatment fluid having the second concentration of activator. The method may return to implement a subsequent stage of the main treatment after the spacing stage. For instances where the pumping time of the main treatment is less than the gelation time of the treatment fluid of the main treatment (at the first concentration of activator), the method may conclude the main treatment(s) and proceed to a flush (e.g., final stage). In particular, the method may flush, for example with a flush volume (e.g., fresh water) of 1 times the volume of the coiled tubing with the fresh water (e.g., treated fresh water) and rig down equipment (remove downhole equipment from the wellbore).

Figure 6:
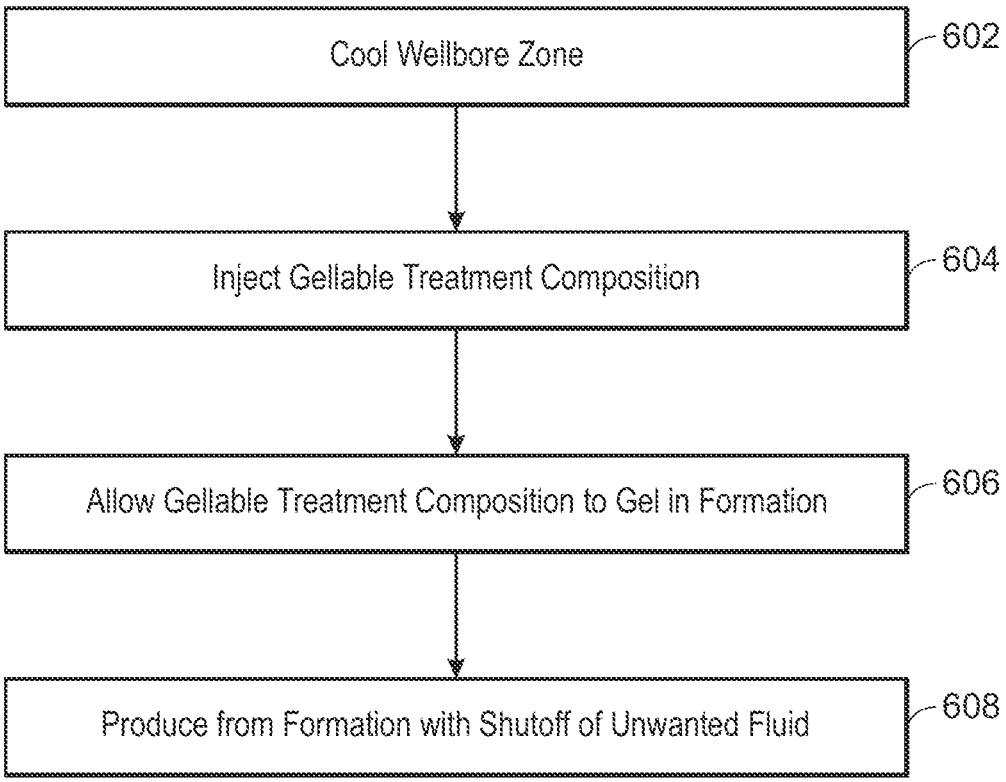
FIG. 6 is a block flow diagram of a method of treating a region of a subterranean formation adjacent a wellbore zone. The block flow diagram may be labeled as a method process flow diagram.

FIG. 6 is a method 600 of treating a region of a subterranean formation adjacent a wellbore zone. The treating may be facilitated by surface equipment (e.g., vessel to hold a treatment composition, a surface pump, etc.) at a well site having a well with a wellbore formed in the subterranean formation. The wellbore includes the wellbore zone. The region of the subterranean formation (to be treated) adjacent the wellbore zone may be at same or similar depth as the wellbore zone.

At block 602, the method includes cooling the wellbore zone to a wellbore temperature below a temperature of the region of the subterranean formation adjacent the wellbore zone. The method may include controlling wellbore temperature of the wellbore zone to prevent or reduce gelling of a gellable treatment composition (that gels with heat) inside the wellbore zone, while allowing the gellable treatment composition to gel in the region of the subterranean formation adjacent the wellbore zone. The wellbore temperature of the wellbore zone may be cooled to at least 35° F. below the formation temperature of the region of the subterranean formation adjacent the wellbore zone. In some implementations, the wellbore zone may be cooled to at least 50° F. (or at least 40° F.) below the formation temperature of the region. The wellbore temperature of the wellbore segment through which treatment fluid flows may be cooled, for example, in a range of 35° F. to 68° F. below the formation temperature of the region of the subterranean formation adjacent the wellbore zone.

At block 604, the method includes injecting (pumping) a gellable treatment composition through the wellbore zone into the region of the subterranean formation adjacent the wellbore zone. The gellable treatment composition may be thermally activated. In implementations, the gellable treatment composition may be pumped through coiled tubing into the wellbore. The injection may be a rigless operation. The method may inject the gellable treatment composition through the wellbore zone into the region of the subterranean formation adjacent the wellbore zone to plug or foul the region to reduce or prevent flow (provide shutoff) of an unwanted fluid into the wellbore. The unwanted fluid may be water or gas (e.g., natural gas), or both. The method may inject one stage or multiple stages of the gellable treatment composition. In some implementations, the gellable treatment composition includes silica nanoparticles and an activator, such as salt. The silica nanoparticles may have diameter less than 150 nm. In other implementations, the gellable treatment composition includes polymer and a crosslinker for crosslinking of the polymer (in presence for formation heat) into a polymer gel. In yet other implementations, the gellable treatment composition can include resins that are matured or polymerized with an activator (e.g., catalyst) into a resin gel for the shutoff.

At block 606, the method includes allowing the gellable treatment composition to gel in the region. This may mean allowing the gellable treatment composition to solidify (e.g., substantially immediately or in less than 10 minutes) inside the formation and create a barrier against flow from the formation. For the injection (block 604) as a main treatment, allowing the gellable treatment composition to gel in the region may mean allowing the gellable treatment composition to gel creating a barrier against flow from the formation. During subsequent production from the subterranean formation, presence of the gel (e.g., now as a a solid barrier) may prevent or reduce flow of the unwanted fluid from the region into the wellbore zone. Moreover, the gelation time of any residual gellable treatment composition inside the wellbore zone may be considerably less than the gelation time of the applied gellable treatment composition in the region of the subterranean formation adjacent the wellbore zone.

At block 608, the method includes producing desired hydrocarbon from the region through the wellbore zone to Earth surface. The gel formed from the gellable treatment composition in the region prevents or reduces production of the unwanted fluid from the region. The method may include flushing residual gellable treatment composition from inside of the wellbore zone prior to producing the desired hydrocarbon from the region. In certain embodiments, the unwanted fluid is water, and the desired hydrocarbon produced is crude oil or natural gas, or both. In implementations, the unwanted fluid includes natural gas or water, or both, and the desired hydrocarbon produced is crude oil. In some implementations, the technique may be implemented to block an unwanted subterranean path or flow from an injection well to nearby wells by means of channels, fractured layers, super-K layers, etc.

In certain implementations, the wellbore is available for removal of the retrievable treatment downhole treatment equipment essentially immediately or in less than 2 hours (or less than 4 hours or less than 8 hours) after completion of injecting the gellable treatment composition through the wellbore zone into the region. In implementations, the wellbore is available for producing the desired hydrocarbon from the region essentially immediately or in less than 2 hours (or less than 4 hours or less than 8 hours) after removal of the downhole treatment equipment. In implementations, the wellbore is available for producing the desired hydrocarbon from the region in less than 4 hours (or less than 8 hours or less than 12 hours) after completion of injecting the gellable treatment composition through the wellbore zone into the region. In some implementations, the gellable treatment composition gels in the region of the subterranean formation essentially immediately or in less than 2 hours (or less than 4 hours or less than 8 hours), and wherein gelation time of the gellable treatment composition at the wellbore temperature of the wellbore zone is at least 2 hours, at least 4 hours, at least 16 hours, at least 24 hours, at least 3 days, or at least 1 week. In certain implementations, shut-in of the well is not implemented while the gellable treatment composition gels in the region of the subterranean formation adjacent the wellbore zone. In embodiments, drilling of the downhole treatment equipment is not implemented to remove the downhole treatment equipment.

An embodiment is a method of treating a region of a subterranean formation adjacent the wellbore zone. The region of the subterranean formation adjacent the wellbore zone may be at the same or similar depth as the wellbore zone. The method includes pumping a gellable treatment composition into a wellbore having the wellbore zone to flow the gellable treatment composition through the wellbore zone to cool the wellbore zone. Such cools the wellbore zone to a temperature lower than the formation temperature of the region of the subterranean formation adjacent the wellbore zone. In particular, the wellbore zone may be cooled to at least 35° C. (or at least 40° C. or at least 50° C.) below the formation temperature of the region.

The method includes pumping the gellable treatment composition into the wellbore to flow the gellable treatment composition through the wellbore zone into the region of the subterranean formation adjacent the wellbore zone to plug the region to prevent or reduce production of an unwanted fluid from the region. The unwanted fluid may be, for example, water or gas, or both. The method includes allowing the gellable treatment composition to gel in the region, thereby preventing or reducing the production of the unwanted fluid from the region into the wellbore zone.

The pumping of the gellable treatment composition through the wellbore zone to cool the wellbore zone and to plug the region of the subterranean formation adjacent the wellbore zone may be completed in an amount of time less than gelation time of the gellable treatment composition at the temperature of the wellbore zone as cooled. Moreover, the gelation time of the gellable treatment composition pumped into the wellbore to cool the wellbore zone may generally be greater than the gelation time of the gellable treatment composition pumped into the wellbore to plug the region.

In implementations, the gellable treatment composition pumped into the wellbore to cool the wellbore zone has a first concentration of an activator (e.g., salt), wherein the gellable treatment composition pumped into the wellbore to plug the region comprises a second concentration of the activator greater than the first concentration.

In implementations, an amount of the gellable treatment composition pumped into the wellbore to cool the wellbore zone is a first amount, wherein an amount of the gellable treatment composition pumped into the wellbore to plug the region is a second amount greater than the first amount.

In implementations, the gellable treatment composition pumped into the wellbore to cool the wellbore zone has a first concentration of silica nanoparticles, wherein the gellable treatment composition pumped into the wellbore to plug the region has a second concentration of the silica nanoparticles greater than the first concentration.

The techniques described herein that treat a subterranean formation with a gellable treatment composition can include treating an injection well (e.g., that injects water or gas) that is in short circuit with a nearby hydrocarbon producer well. A subterranean path may exist between the wellbore of the injection well and the wellbore of the hydrocarbon producer well. The treatment with the gellable treatment composition may plug the path in the formation at the injection well. The injection well may be for injecting water or injecting gas into the subterranean formation. The treatment with gellable treatment composition, as discussed herein, my block an unwanted path or flow through, for example, fractured layers or super-k layers, to the nearby producing well.

An embodiment is a method of treating a region of a subterranean formation adjacent a wellbore zone, the method including cooling the wellbore zone to a wellbore temperature below a temperature of the region of the subterranean formation adjacent the wellbore zone, injecting (e.g., via rigless operation) a gellable treatment composition through the wellbore zone into the region of the subterranean formation adjacent the wellbore zone, and allowing the gellable treatment composition to gel (e.g., gelling is thermally activated) in the region to prevent or reduce flow of an unwanted fluid (e.g., water or natural gas, or both) from the region into the wellbore zone. The wellbore temperature of the wellbore zone may be cooled to at least 40° F. (22.2° C.) less the temperature of the region of the subterranean formation adjacent the wellbore zone. In implementations, the gellable treatment composition gels in the region of the subterranean formation in less than 3 hours. In implementations, shut-in of a well having the wellbore zone is not implemented while the gellable treatment composition gels in the region. In implementations, the gelation time of the gellable treatment composition at the wellbore temperature of the wellbore zone is at least 3 days. The method may include removing downhole devices that applied the gellable treatment composition in the injecting of the gellable treatment composition, wherein removing involves removing the downhole devices without drilling the downhole devices and in less than 8 hours after completion of injecting the gellable treatment composition through the wellbore zone into the region. The method includes producing desired hydrocarbon (e.g., crude oil or natural gas, or both) from the region through the wellbore zone to Earth surface, wherein a gel formed from the gellable treatment composition in the region prevents or reduces production of the unwanted fluid from the region. The producing may include producing the desired hydrocarbon from the region starting in less than 12 hours after completion of injecting the gellable treatment composition through the wellbore zone into the region.

Another embodiment is a method of treating a region of a subterranean formation adjacent a wellbore zone, the method including pumping a gellable treatment composition into a wellbore comprising the wellbore zone to flow the gellable treatment composition through the wellbore zone to cool the wellbore zone to a temperature lower than formation temperature of the region of the subterranean formation adjacent the wellbore zone. In implementations, the region of the subterranean formation adjacent the wellbore zone is at the same depth as the wellbore zone. The pumping of the gellable treatment composition to cool the wellbore zone may include cooling the wellbore zone to at least 30° F. (16.7° C.) below the formation temperature of the region of the subterranean formation adjacent the wellbore zone. In implementations, the pumping of the gellable treatment composition to cool the wellbore zone includes cooling the wellbore zone to at least 50° F. (27.8° C.) below the formation temperature of the region of the subterranean formation adjacent the wellbore zone.

The method includes pumping the gellable treatment composition into the wellbore to flow the gellable treatment composition through the wellbore zone into the region of the subterranean formation adjacent the wellbore zone to plug the region to prevent or reduce flow of an unwanted fluid (e.g., water or natural gas, or both) from the region. In implementations, the gellable treatment composition pumped into the wellbore to cool the wellbore zone has a first concentration of an activator (e.g., accelerator, salt, crosslinker, catalyst, acid, etc.), wherein the gellable treatment composition pumped into the wellbore to plug the region has a second concentration of the activator greater than the first concentration. In implementations, an amount of the gellable treatment composition pumped into the wellbore to cool the wellbore zone is a first amount, wherein an amount of the gellable treatment composition pumped into the wellbore to plug the region is a second amount greater than the first amount. In implementations, the gellable treatment composition pumped into the wellbore to cool the wellbore zone has a first concentration of a thermosetting chemical (e.g., silica nanoparticles, polymer, or resin), wherein the gellable treatment composition pumped into the wellbore to plug the region has a second concentration of the thermosetting chemical greater than the first concentration.

The method includes allowing the gellable treatment composition to gel in the region, thereby preventing or reducing the flow of the unwanted fluid from the region. In implementations, the gelation time of the gellable treatment composition pumped into the wellbore to cool the wellbore zone is greater than gelation time of the gellable treatment composition pumped into the wellbore to plug the region. In implementations, the pumping of the gellable treatment composition through the wellbore zone to cool the wellbore zone and to plug the region of the subterranean formation adjacent the wellbore zone is completed in an amount of time less than gelation time of the gellable treatment composition at the temperature of the wellbore zone as cooled.

The flow of the unwanted fluid from the region may be production of the unwanted fluid of the region into the wellbore zone. In other implementations, an injection well includes the wellbore, wherein the injection well is short circuited through the subterranean formation via the region to a second well, wherein the unwanted fluid includes fluid injected via the injection well into the subterranean formation, and wherein the flow of the unwanted fluid from the region includes flow of the unwanted fluid from the region to the second well.

Yet another embodiment is a method of treating a region of a subterranean formation adjacent a wellbore zone, the method including pumping a gellable treatment composition through coiled tubing and the wellbore zone into the region of the subterranean formation adjacent the wellbore zone to shutoff flow of water or gas, or both, from the region into the wellbore zone. The method includes controlling wellbore temperature of the wellbore zone to prevent or reduce gelling of the gellable treatment composition in the wellbore zone. The controlling of the wellbore temperature of the wellbore zone may involve cooling the wellbore zone to a temperature at least 50° F. (27.8° C.) lower than formation temperature of the region. Controlling the wellbore temperature of the wellbore zone may involve cooling the wellbore zone to a temperature at least 35° F. (19.4° C.) lower than formation temperature of the region. The method includes allowing the gellable treatment composition to form a gel in the region, thereby providing for the shutoff of the flow of water or gas, or both. In implementations, the gellable treatment may have a resin forms a resin matrix or resin gel. In other implementations, the gellable treatment composition may have polymer and a crosslinker. In yet other implementations, the gellable treatment composition includes silica nanoparticles and an activator that is a salt, wherein the silica nanoparticles have a diameter less than 150 nanometers.

EXAMPLES

The Examples are only examples and not intended to limit the present techniques. Examples 1-5 are presented.

Example 1

A gellable treatment composition having NaSil and an activator in water was tested in the laboratory for gelation time as a function of temperature of the gellable treatment composition. The activator (sodium silicate and potassium silicate) was at various concentrations (see FIG. 7A) in the composition. The activator was at a concentration in a range of 20 wt % to 40 wt % in the composition. The results of the gelation time tests performed in the laboratory are depicted in FIG. 7A. The results confirm that gelation time is inversely related to activator concentration. The gelation time is less with increasing activator concentration.

FIG. 7A is a plot 700 of gelation time 702 in hours (hrs) of the gellable treatment composition versus the temperature 704 (° F.) of the gellable treatment composition. Four curves 706, 708, 712, and 714 are given. The curve 706 is for the gellable treatment composition having an activator concentration of 20 wt %. The curve 708 is for the gellable treatment composition having an activator concentration of 25 wt %. The curve 712 is for the gellable treatment composition having an activator concentration of 30 wt %. The curve 714 is for the gellable treatment composition having an activator concentration of 40 wt %. As can be seen in FIG. 7A, the gelation time 702 can be considerably shorter at higher concentrations of activator. For instance, the results indicate that a gelation time 702 at an example formation temperature of 210° F. for the gellable treatment composition having the activator at a concentration of 30 wt % or 40 wt % would be about 10 minutes. The gelation time 702 can be sensitive to changes in the activator concentration.

Example 2

A gellable treatment composition having a polymer and a crosslinker was tested in the laboratory for gelation time as a function of temperature of the gellable treatment composition. The polymer included homopolymer polyacrylamide and the crosslinker was polyethyleneimine. The crosslinker was at various concentrations (see FIG. 7B) in the composition. The crosslinker was at a concentration in a range of 2 vol % to 6 vol % in the composition. The results of the gelation time tests performed in the laboratory are depicted in FIG. 7B. The results confirm that gelation time is inversely related to the crosslinker concentration. The gelation time is less with increasing crosslinker concentration.

FIG. 7B is a plot of gelation time in hours (hrs) of the gellable treatment composition versus the concentration (vol %) of the crosslinker in the composition. The four curves are for the composition at 175° F., 200° F., 225° F., and 250° F., respectively As can be seen in FIG. 7B, the gelation time can be considerably shorter at higher concentrations of crosslinker. Also, the gelation time increases with increasing temperature.

Example 3

Setting time (gelation time) data for various thermosetting resin composition was averaged as a function of temperature and concentration of an activator (an accelerator, such as a catalyst) in the resin composition. FIG. 7C is a plot of setting time in minutes (min) of the resin compositions versus the temperature (F) of the compositions. The three curves are for concentration (vol %) of the accelerator in the thermosetting resin compositions at 0.25 vol %, 0.20 vol %, and 0.15 vol %, respectively. As can be seen in FIG. 7C, the setting time (gelation time) is inversely related to both accelerator concentration and temperature.

Example 4

Figure 8:
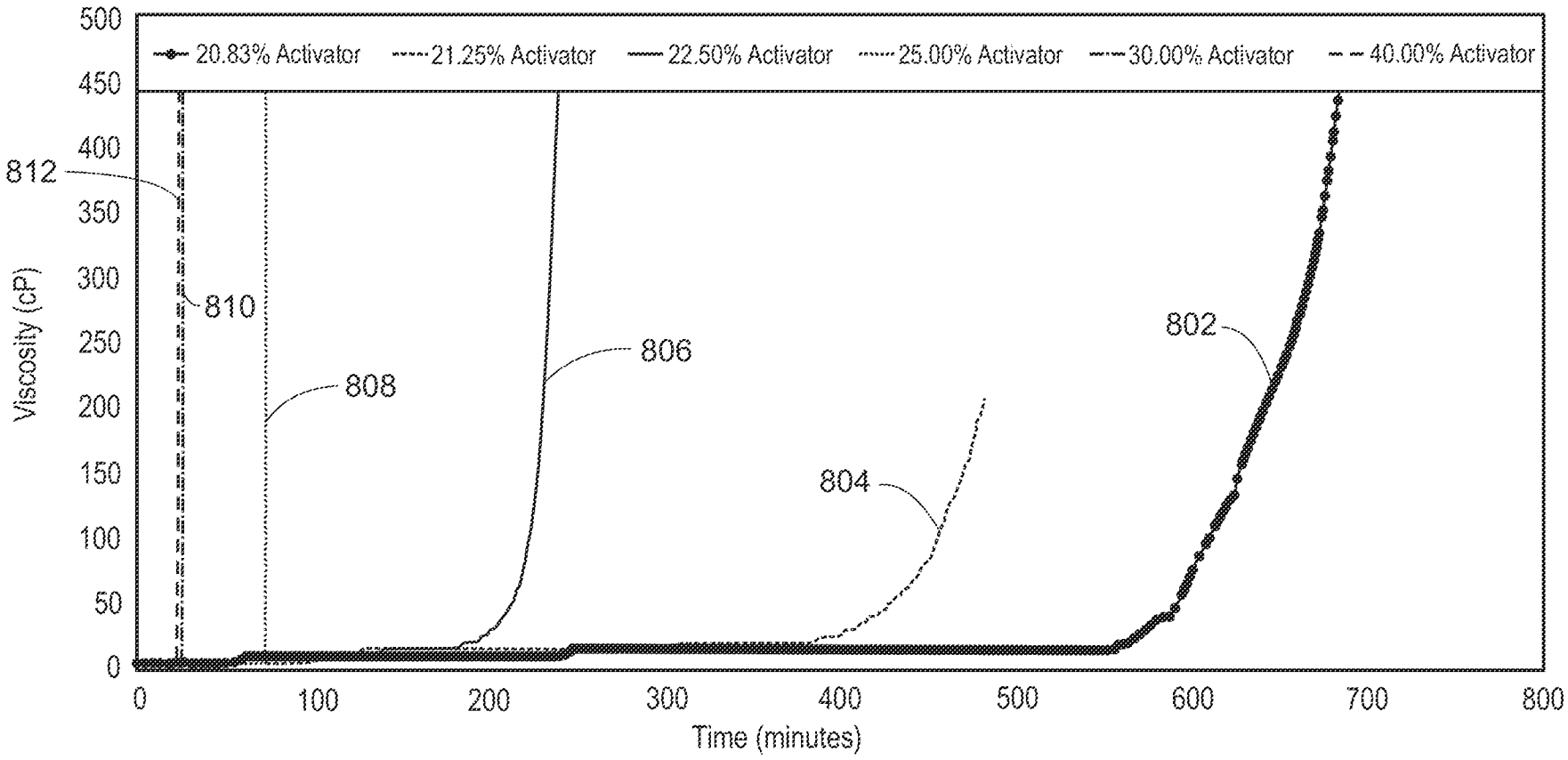
FIG. 8 is a plot of viscosity of a gellable treatment composition over time at a constant temperature.

A gellable treatment composition having NaSil and an activator (sodium silicate and potassium silicate) in water was tested in the laboratory for viscosity over time at a constant temperature (isothermal) of the gellable treatment composition. The activator was at various concentrations (see FIG. 8) in the composition. The results of these viscosity tests performed in the laboratory are depicted in FIG. 8. All viscosity tests in Example 4 were performed with the gellable treatment composition at a temperature of 210° F.

FIG. 8 is a plot 800 of viscosity in centipoise (cP) of the gellable treatment composition over time (minutes) at a constant temperature of 210° F. The time of zero minutes (at beginning) is at the mixing of the NaSil and the activator in the water. An increase in viscosity of the gellable treatment composition indicates the onset of gelation. The curve 802 is for the gellable treatment composition having an activator concentration of 20.83 wt %. The curve 804 is for the gellable treatment composition having an activator concentration of 21.25 wt %. The curve 806 is for the gellable treatment composition having an activator concentration of 22.50 wt %. The curve 808 is for the gellable treatment composition having an activator concentration of 25.00 wt %. The curve 810 is for the gellable treatment composition having an activator concentration of 30.00 wt %. The curve 812 is for the gellable treatment composition having an activator concentration of 40.00 wt %.

The curves 810 and 812 at an activator concentration of 30.00 wt % and 40.00 wt %, respectively, indicate gelling of the gellable treatment composition in less than 20 minutes. The curves 810 and 812 are close to each other and barely distinguishable at the scale of the plot 800. The onset of viscosity increase for curve 810 (30 wt % activator) is 2 minutes later than the onset of viscosity for curve 812 (40 wt % activator). However, at a temperature of 150° F., as can be noted with respect to FIG. 7A, the composition with 40 wt % activator gels at about 4.8 hours (gelation time) and the composition with 30 wt % activator gels at over 20 hours (gelation time).

A hypothetical scenario is the above-tested composition having 30 wt % activator applied to a subterranean formation, and in which the formation static temperature at the zone being treated is 210° F. and the wellbore dynamic temperature at the zone being treated is 150° F. The gelation time at 210° F. is about 20 minutes. Thus, the composition in the formation gels in about 20 minutes. The gelation time at 150° F. is about 22 hours. Thus, the composition in the wellbore generally does not have time to gel in the wellbore because the squeeze operation can be completed in less than 22 hours, such as less than 1 hour, less than 2 hours, or less than 3 hours.

Example 5

Figure 9:
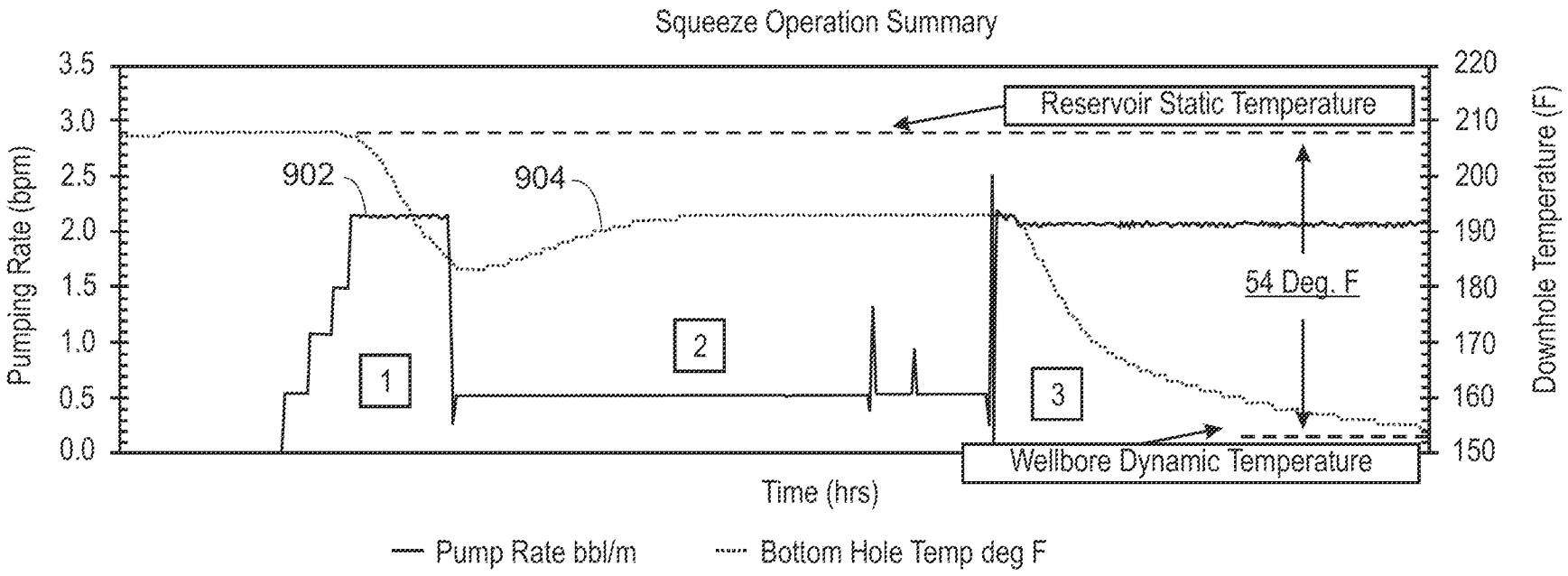
FIG. 9 is a plot of a squeeze operation summary performed at a well site in the field over time.

FIG. 9 is a plot 900 of a squeeze operation summary performed at a well site in the field over time. A gellable treatment composition, which is an aqueous dispersion of NaSil in water with sodium silicate and potassium silicate as an activator, was pumped from the Earth surface (via a surface pump) into an openhole wellbore having a production tubing and completion packers. Coiled tubing was used to convey the gellable treatment composition into the wellbore. For the squeeze of the gellable treatment composition into the formation from the wellbore, a retrievable production packer and a retrievable bridge plug were employed.

The total length of time (along the x-axis) of the squeeze operation depicted is about 3 hours. The depicted x-axis length is about 7 hours in total. The curve 902 is for pumping rate of the gellable treatment composition in barrels per minute (bpm or bbl/m) over time in hours (hrs).

The curve 904 is the wellbore temperature (or bottomhole temperature) in ° F. at the wellbore zone being treated. This wellbore temperature was measured via temperature sensors and a coil telemetry system. Both formation temperature and wellbore temperature generally vary as a function of depth. The wellbore temperature of interest is the wellbore temperature at the wellbore segment being treated. The temperature curve 904 may be considered the wellbore dynamic temperature at the zone of interest. During static conditions in the wellbore, the wellbore temperature may be equal to the formation temperature. In contrast, embodiments of the present techniques under dynamic conditions in the wellbore (with pumping of cool fluid into the wellbore) may control the wellbore temperature as different (lower) than the formation static temperature.

The formation (reservoir) static temperature is indicated by the dashed line at about 208° F. This formation static temperature is the static temperature of the subterranean formation at the depth of the zone of interest (to be treated). A desired or target wellbore temperature at the zone being treated may be, for example, at about 154° F., which is 54° F. less than the formation temperature of 208° F.

FIG. 9 shows three different events over the 7 hours. The last 2 hours represent the staged treatment with NaSil. The denoted box 1 points to event 1, which has a duration of about one hour and includes determining that the wellbore temperature changes as a function of water pumping rate. These data acquired are utilized to develop and adjust the subsequent pumping schedule. The denoted box 2 points to event 2, which has a duration of about 3 hours and includes maintaining the wellbore cool with water at relatively low pumping rate while mixing the first NaSil batches at surface and accommodating operating personnel issues.

The denoted box 3 points to event 3, which has a duration of about 2 hours and includes treatment with NaSil. First, a batch of the NaSil composition with 25 wt % activator was pumped at 2 barrels per minute (bpm) to knock down the wellbore temperature. Second, a batch of the NaSil composition with 30 wt % activator was pumped into the wellbore. Third, a spacing batch of the NaSil composition with 20 wt % activator was pumped into the wellbore. Fourth, a remaining main treatment volume of the NaSil composition with 30 wt % activator was pumped into the wellbore. Each these four pumping stages lasted about 30 minutes, respectively. Once the fourth pumping stage was completed, the coil tubing volume was spaced twice, first with the NaSil composition at 20 wt % activator concentration, and second with water.

A number of implementations have been described. Nevertheless, it will be understood that various modifications may be made without departing from the spirit and scope of the disclosure.

What is claimed is:

1. A method of treating a region of a subterranean formation adjacent a wellbore zone, the method comprising:

cooling the wellbore zone to a wellbore temperature below a temperature of the region of the subterranean formation adjacent the wellbore zone using a first gellable treatment composition comprising a first concentration of an activator;

injecting a second gellable treatment composition through the wellbore zone into the region of the subterranean formation adjacent the wellbore zone, the second gellable composition comprising a second concentration of the activator greater than the first concentration of the activator;

allowing the second gellable treatment composition to gel in the region to prevent or reduce flow of an unwanted fluid from the region into the wellbore zone; and producing desired hydrocarbon from the region through the wellbore zone to Earth surface, wherein a gel formed from the second gellable treatment composition in the region prevents or reduces production of the unwanted fluid from the region.

2. The method of claim 1, wherein cooling the wellbore zone comprises cooling the wellbore zone to a wellbore temperature that is at least 40° F. (22.2° C.) below the temperature of the region of the subterranean formation adjacent the wellbore zone, and wherein the second gellable treatment composition is thermally activated.

3. The method of claim 1, comprising removing downhole devices that applied the second gellable treatment composition in the injecting of the second gellable treatment composition, wherein removing comprises removing the downhole devices without drilling the downhole devices and in less than 8 hours after completion of injecting the second gellable treatment composition through the wellbore zone into the region.

4. The method of claim 1, wherein shut-in of a well comprising the wellbore zone is not implemented while the second gellable treatment composition gels in the region, and wherein producing comprises producing the desired hydrocarbon from the region starting in less than 12 hours after completion of injecting the second gellable treatment composition through the wellbore zone into the region.

5. The method of claim 1, wherein gelling of the second gellable treatment composition is thermally activated, wherein the wellbore temperature of the wellbore zone is cooled, using the first gellable treatment composition, to at least 40° F. (22.2° C.) less the temperature of the region of the subterranean formation adjacent the wellbore zone, and wherein injecting the second gellable treatment composition is a rigless operation.

6. The method of claim 1, wherein the second gellable treatment composition gels in the region of the subterranean formation in less than 3 hours, and wherein gelation time of the second gellable treatment composition at the wellbore temperature of the wellbore zone is at least 3 days.

7. The method of claim 1, wherein the unwanted fluid comprises water, and wherein the desired hydrocarbon produced comprises crude oil or natural gas, or both.

8. The method of claim 1, wherein the unwanted fluid comprises natural gas, and wherein the desired hydrocarbon produced comprises crude oil.

9. A method of treating a region of a subterranean formation adjacent a wellbore zone, the method comprising:

pumping a first gellable treatment composition into a wellbore comprising the wellbore zone to flow the first gellable treatment composition through the wellbore zone to cool the wellbore zone to a temperature lower than formation temperature of the region of the subterranean formation adjacent the wellbore zone;

pumping a second gellable treatment composition into the wellbore to flow the second gellable treatment composition through the wellbore zone into the region of the subterranean formation adjacent the wellbore zone to plug the region to prevent or reduce flow of an unwanted fluid from the region into the wellbore, wherein the second gellable treatment composition is heat activated, wherein the first gellable treatment composition pumped into the wellbore to cool the wellbore zone comprises a first concentration of an activator, and wherein the second gellable treatment composition pumped into the wellbore to plug the region comprises a second concentration of the activator greater than the first concentration of the activator; and allowing the second gellable treatment composition to gel in the region, thereby preventing or reducing the flow of the unwanted fluid from the region.

10. The method of claim 9, wherein the flow of the unwanted fluid from the region into the wellbore comprises production of the unwanted fluid of the region into the wellbore zone, and wherein the activator comprises an accelerator, a salt, or a crosslinker.

11. The method of claim 9, wherein an amount of the first gellable treatment composition pumped into the wellbore to cool the wellbore zone comprises a first amount of the activator, and wherein an amount of the second gellable treatment composition pumped into the wellbore to plug the region comprises a second amount of the activator greater than the first amount of the activator.

12. The method of claim 9, wherein pumping the first gellable treatment composition to cool the wellbore zone comprises cooling the wellbore zone to at least 35° F. (19° C.) below the formation temperature of the region of the subterranean formation adjacent the wellbore zone.

13. The method of claim 9, wherein gelation time of the first gellable treatment composition pumped into the wellbore to cool the wellbore zone is greater than gelation time of the second gellable treatment composition pumped into the wellbore to plug the region.

14. The method of claim 9, wherein pumping the first gellable treatment composition through the wellbore zone to cool the wellbore zone and pumping the second gellable treatment composition through the wellbore zone to plug the region of the subterranean formation adjacent the wellbore zone is completed in an amount of time less than gelation time of the second gellable treatment composition at the temperature of the wellbore zone as cooled.

15. The method of claim 9, wherein an injection well comprises the wellbore, wherein the injection well is short circuited through the subterranean formation via the region to a second well, wherein the unwanted fluid comprises fluid injected via the injection well into the subterranean formation, and wherein the flow of the unwanted fluid from the region comprises flow of the unwanted fluid from the region to the second well.

16. The method of claim 9, wherein the first gellable treatment composition pumped into the wellbore to cool the wellbore zone comprises a first concentration of silica nanoparticles, and wherein the second gellable treatment composition pumped into the wellbore to plug the region comprises a second concentration of the silica nanoparticles greater than the first concentration of the silica nanoparticles.

17. The method of claim 9, wherein the first gellable treatment composition pumped into the wellbore to cool the wellbore zone comprises a first concentration of a crosslinker, and wherein the second gellable treatment composition pumped into the wellbore to plug the region comprises a second concentration of the crosslinker greater than the first concentration of the crosslinker.

18. The method of claim 9, wherein the region of the subterranean formation adjacent the wellbore zone is at same depth as the wellbore zone, wherein the unwanted fluid comprises water or gas, or both, and wherein pumping the first gellable treatment composition to cool the wellbore zone comprises cooling the wellbore zone to at least 50° F. (27.8° C.) below the formation temperature of the region of the subterranean formation adjacent the wellbore zone.

19. The method of claim 9, wherein gelation time of the first gellable treatment composition pumped into the wellbore to cool the wellbore zone is greater than gelation time of the second gellable treatment composition pumped into the wellbore to plug the region.

20. A method of treating a region of a subterranean formation adjacent a wellbore zone, the method comprising:

pumping a first gellable treatment composition through coiled tubing and the wellbore zone into the region of the subterranean formation adjacent the wellbore zone to shutoff flow of water or gas, or both, from the region into the wellbore zone, wherein the first gellable treatment composition is heat activated;

controlling wellbore temperature of the wellbore zone to prevent gelling of the first gellable treatment composition in the wellbore zone, wherein the wellbore temperature of the wellbore zone is controlled using a second gellable treatment composition, wherein the first gellable treatment composition comprises a first concentration of an activator, and wherein the second gellable treatment composition comprises a second concentration of the activator lesser than the first concentration of the activator; and allowing the first gellable treatment composition to form a gel in the region, thereby preventing or reducing the flow of water or gas, or both.

21. The method of claim 20, wherein the first gellable treatment composition is activated by a chemical activator in the first gellable treatment composition, and wherein controlling the wellbore temperature of the wellbore zone comprises cooling the wellbore zone to a temperature at least 50° F. (27.8° C.) lower than formation temperature of the region.

22. The method of claim 20, wherein the first gellable treatment composition comprises silica nanoparticles and an activator comprising a salt, wherein the silica nanoparticles comprise a diameter less than 150 nanometers, and wherein controlling the wellbore temperature of the wellbore zone comprises cooling the wellbore zone to a temperature at least 35° F. (19.4° C.) lower than formation temperature of the region.

23. The method of claim 20, wherein the first gellable treatment composition comprises polymer and a crosslinker to crosslink the polymer, and wherein controlling the wellbore temperature of the wellbore zone comprises cooling the wellbore zone to a temperature at least 35° F. (19.4° C.) lower than formation temperature of the region.

24. The method of claim 23, wherein the polymer comprises a polyacrylamide homopolymer or a copolymer of acrylamide monomer units and acrylate monomer units, or both, and wherein the crosslinker comprises polyethyleneimine.

25. The method of claim 20, wherein the first gellable treatment composition comprises a resin and an activator to activate the resin to form the gel, and wherein controlling the wellbore temperature of the wellbore zone comprises cooling the wellbore zone to a temperature at least 35° F. (19.4° C.) lower than formation temperature of the region.

* * * * *